United States Patent [19]

Hirano et al.

[11] Patent Number: 4,504,159

[45] Date of Patent: Mar. 12, 1985

[54] COMPACT SERIAL PRINTER WITH RACK PLATE DRIVE FOR TYPE BELT DRUM

[75] Inventors: Hirofumi Hirano, Arakawa; Hitoshi Hasumi, Chichibu, both of Japan

[73] Assignee: Canon Denshi Kabushiki Kaisha, Saitama, Japan

[21] Appl. No.: 424,538

[22] Filed: Sep. 27, 1982

[30] Foreign Application Priority Data

| | | | |
|---|---|---|---|
| Nov. 9, 1981 | [JP] | Japan | 56-178379 |
| Nov. 20, 1981 | [JP] | Japan | 56-185270 |
| Nov. 20, 1981 | [JP] | Japan | 56-185271 |
| Nov. 20, 1981 | [JP] | Japan | 56-185272 |
| Dec. 1, 1981 | [JP] | Japan | 56-191835 |
| Dec. 1, 1981 | [JP] | Japan | 56-191836 |
| Dec. 2, 1981 | [JP] | Japan | 56-192801 |

[51] Int. Cl.[3] ..... B41J 1/20

[52] U.S. Cl. ..... 400/148; 400/161.4; 101/93.2

[58] Field of Search ..... 400/148, 145.2, 146, 400/152, 25, 161.1, 161.4, 161.5; 101/329, 205, 106, 93.2

[56] References Cited

U.S. PATENT DOCUMENTS

| | | | |
|---|---|---|---|
| 1,328,158 | 1/1920 | Kousnetzoff et al. | 400/145.2 |
| 1,450,627 | 4/1923 | Darnley | 400/146 |
| 3,405,794 | 10/1968 | Means | 400/161.4 |
| 3,640,369 | 2/1972 | Rolph | 400/145.2 |
| 3,717,234 | 2/1973 | Koller | 400/145.2 |
| 3,913,722 | 10/1975 | Bowdle et al. | 400/145.2 |
| 4,416,557 | 11/1983 | Arai | 400/152 |

FOREIGN PATENT DOCUMENTS

| | | | |
|---|---|---|---|
| 1575348 | 7/1969 | France | 400/145.2 |

OTHER PUBLICATIONS

"Spiral Print Element for Impact Printer", IBM Technical Disclosure Bulletin, vol. 21, No. 10, Mar. 1979, pp. 4092–4093.

*Primary Examiner*—E. H. Eickholt

*Attorney, Agent, or Firm*—Fitzpatrick, Cella, Harper & Scinto

[57] ABSTRACT

A printer having a plurality of type belts and capable of printing in two colors by a rolling contact system is disclosed. The printer prevent mixing of colors of printed characters by lifting up and down a print paper for printing the characters at different positions on a platen by the different color type belts.

5 Claims, 42 Drawing Figures

COMPACT SERIAL PRINTER WITH RACK PLATE DRIVE FOR TYPE BELT DRUM

BACKGROUND OF THE INVENTION

1. Field of the Invention

The present invention relates to a print mechanism of a serial printer used in an electronic desk-top calculator or the like.

2. Description of the Prior Art

In a prior art serial printer which serially prints characters, in order to raise a print speed, a print time and a carriage shift time must be reduced and a type drum must be rotated fast. In a flying hammer type printer, the print time is short because the type drum is not stopped but when the type drum is rotated at a high speed, characters may not be perfectly printed or characters may be misaligned. In addition, since the carriage shift is effected during one revolution of the type drum, only one character can be printed in one revolution of the drum and the speed-up of the printing is limited. In a static print type printer, the type drum may be rotated at a high speed because a print quality is guaranteed by stopping the drum at a predetermined position. However, since a D.C. motor is used as a drive source in many cases considering saving of power consumption, the printer requires a clutch between the motor and the type drum. It also needs a time to stop the drum to print characters and carriage shift time after printing. Accordingly, the speed-up of the printing is limited, too.

SUMMARY OF THE INVENTION

It is an object of the present invention to provide a serial printer which carries out the printing and the carriage shift simultaneously so that a high print speed that could not be obtained in the prior art serial printer is attained.

It is another object of the present invention to provide a serial printer which is simple in construction, of small size and inexpensive.

It is other object of the present invention to provide a compact serial printer having various improvements.

It is a further object of the present invention to provide a serial printer capable of printing characters in two colors such as red and black with a small mechanism.

BRIEF DESCRIPTION OF THE DRAWINGS

FIGS. 10–20 show a further embodiment of the present invention, in which FIG. 10 shows a front perspective view, FIG. 11 shows a rear perspective view, FIG. 13 shows a timing chart for black color printing, FIG. 16 shows a timing chart for red color printing, and FIGS. 14, 15, 17, 18, 19 and 20 illustrate paper feed, FIGS. 25–30 show a still further embodiment of the present invention, in which FIG. 25 shows a front perspective views, FIG. 26 shows a rear perspective view, FIGS. 28 and 29 illustrate operations of a ratchet wheel and a pawl lever in a paper feed operation, and FIG. 30 illustrates an engaging condition of the ratchet wheel and a stop lever, and FIGS. 31–33 show details of an ink roll case mount mechanism in the respective embodiments, in which FIG. 31 shows a developed perspective view and FIGS. 32 and 33 show side elevational views illustrating an ink roll case mounting condition.

DESCRIPTION OF THE PREFERRED EMBODIMENTS

FIGS. 1–6 show a basic construction of the present invention which is similar to that disclosed in patent application Ser. No. 356,101, now U.S. Pat. No. 4,437,776 which issued Mar. 20, 1984.

Figure 1A:
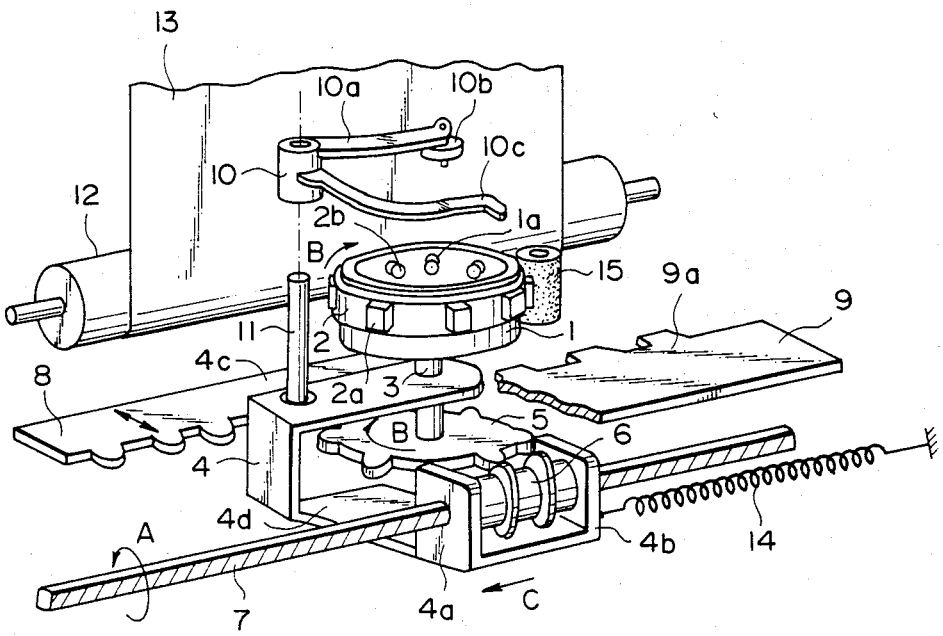
FIGS. 1A–6 show a basic construction of the present invention.
Figure 1B:
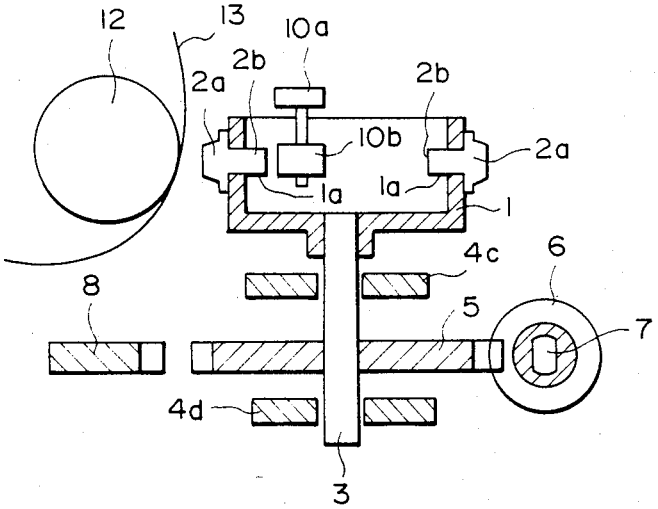

FIGS. 1A and 1B shows a developed perspective view and a sectional view of an overall construction Numeral 1 denotes a type drum base having a plurality of apertures 1*a* and having a type belt 2 made of an elastic material such as rubber wrapped around an outer periphery thereof. The type belt 2 has types 2*a* and projections 2*b* opposing thereto to fit into the apertures 1*a*. By impacting the projection 2*b* from the inside of the type drum base 1, the type 2*a* is projected. Numeral 3 denotes a drum shaft which is fixed to the type drum base 1 at one end thereof and rotatably supported by a carrier 4 and has a drive gear 5 attached thereto at the other end thereof.

Numeral 6 denotes a worm gear which has its thrust direction restricted by bent portions 4*a* and 4*b* of the carrier 4 and engages with the drive gear 5 and is held by a worm gear shaft 7.

The worm gear shaft 7 is rotatably supported between side plates, not shown, and driven by a drive motor at a predetermined rotational speed. The worm gear shaft 7 has an oval section and slidably engages with an oval hole formed in the worm gear 6.

Numeral 8 denotes a type selection member for the type drum which has rack teeth. When it is urged toward the type drum base 1 by a solenoid, not shown, it can engage with the drive gear 5. Numeral 9 denotes a print cam having cam portions 9*a* for uging a hammer 10 to be described later arranged on a side thereof at a predetermined pitch. Numeral 10 denotes the print hammer which has an arm 10*a* for holding a roll 10*b* for impacting the back projection 2*b* of the type 2*a* and an impacting arm 10*c* which is engageable with the print cam 9. It is rotatably supported by a hammer shaft 11 mounted on the carrier 4.

Numeral 12 denotes a platen and numeral 13 denotes a print paper. Numeral 15 denotes an ink roll which is press-contacted to the type drum to transfer ink to the type surfaces. The carrier 4 is guided by a guide shaft, not shown and movable in parallel to the platen 12.

Numeral 14 denotes a return spring which normally pulls the carrier in a given direction.

The operation of the print mechanism of the present embodiment thus constructed is now explained with reference to FIGS. 1, 2, 3 and 4.

Figures 1, 2A:
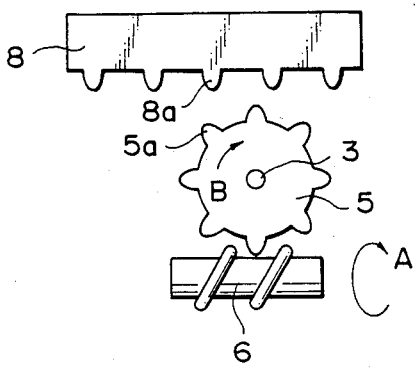
Figure 3A:
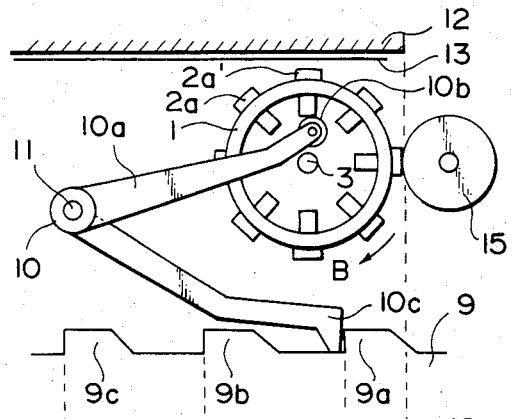

When the worm gear shaft 7 is rotated by a motor, not shown, in a direction of an arrow A, the worm gear 6 is also rotated in the same direction. Since the drive gear 5 meshes with the worm gear 6, the drive gear 5 is also rotated in the direction of an arrow B and the type drum base 1 which is integrally attached to the drum shaft 3 is also rotated in the direction B. (FIGS. 2A-1 and 3A).

Figures 2, 2A:
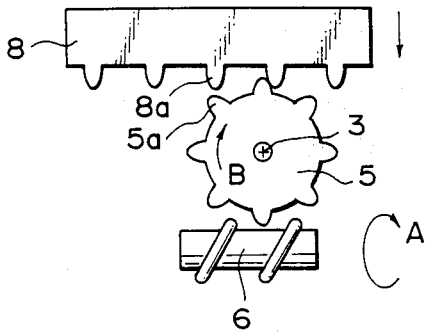

When a selected one of the types 1*a* is to be printed, the type selection member 8 is advanced by solenoid, not shown, to engage with one of teeth 5*a* of the gear 5 which has teeth 5*a* corresponding to the respective types on the type drum base 1 at a predetermined position so that the rack tooth 8*a* of the type selection member 8 engages with the tooth 5*a* of the drive gear 5. (FIG. 2A-2).

Figure 2B:
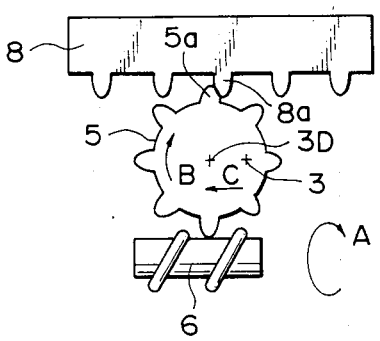

Since the rotating force is still imparted to the drive gear 5, the drive gear 5 tends to rotate the rack tooth 8*a* of the type selection member 8 around the support point. As a result, the rotation center of the drive gear 5 is shifted from a point 3 to a point 3D. (FIG. 2B). This condition is similar to a condition in which a pinion rolls over a rack while it engages with each other in a rack-pinion combination.

Figure 2C:
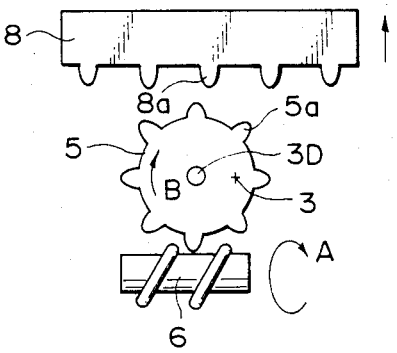
Figure 3B:
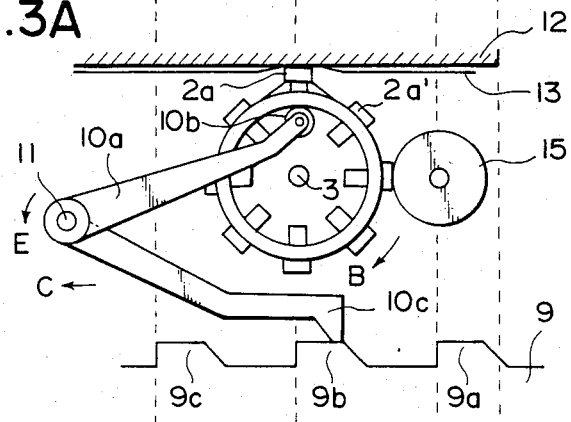
Figure 3C:
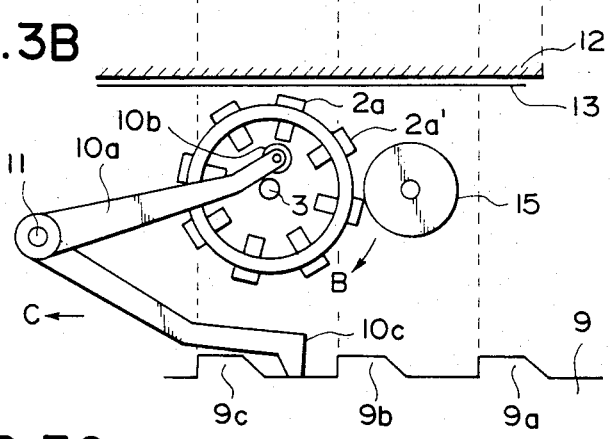
Figure 4:
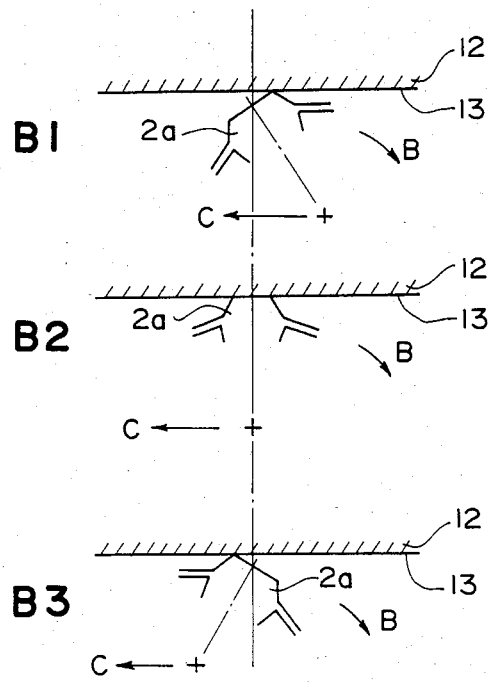

As the type drum 1 moves in a carriage shift direction c while rolling, the carrier 4 also moves in the carriage shift direction c. The carrier 4 rotatably supports the hammer 10 and the impacting arm 10*c* of the hammer 10 engages with the cam portion 9*a* of the print cam 9. As the hammer 10 moves in the carriage shift direction c together with the carrier 4, the impacting arm 10*c* tends to ride over the cam portion 9*a* and rotates in a direction E so that the pressing roll 10*b* presses the back projection 2*b* of the type belt 2 and the type contacts with the print paper 13 to transfer the ink (FIG. 3B). As the carrier 4, the type drum base 1 and the hammer 10 move together in the carriage shift direction c and impacting arm 10*c* of the hammer 10 tends to ride over the cam portion 9*a* of the print cam 9, the type moves away from the print paper 13 and the print operation terminates (FIG. 3C). As the solenoid which has pressed the type selection member 8 is deenergized to disengage the rack tooth 8*a* of the type selection member 8 from the drive gear 5, the type drum 1 stops to roll and continues to rotate at that position (FIG. 2C). The return spring 14 now pulls the carrier 4 but the carrier 4 is not returned because the impacting arm 10*c* of the hammer 10 engages with the cam portion 9*b* of the print cam 9 as shown in FIG. 3A.

Characters are sequentially printed in the same manner, and when a line of characters has been printed, the print cam 9 is moved away from the type drum 1 so that the impacting arm 10*c* of the hammer 10 is disengaged from the cam portion 9 and it is returned to a predetermined position by the tension of the return spring 14. When the characters to be printed on one line are serial numbers like 1, 2, 3, 4, . . . , the characters are sequentially printed and shifted in one movement of the type selection member 8 and hence high speed printing is attained. A print pitch (character-to-character interval) is equal to $m\pi$ where m is a module of the teeth of the drive gear 5. A pitch of the racks of the type selection member 8 and a pitch of the cams of the print cam 9 are also equal to $m\pi$. FIGS. 4B1–4B3 show time-enlarged charts of FIG. 3B.

Figure 5:
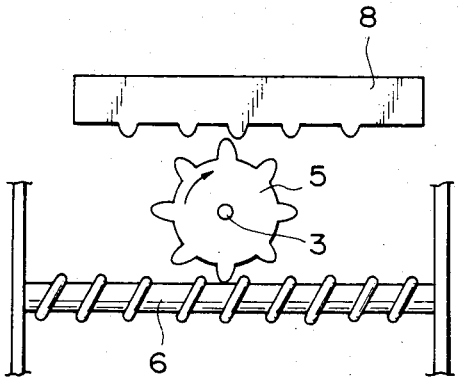

FIG. 5 shows another embodiment of the present invention, in which the worm gear extends over an entire width of the movement of the drum. In the previous embodiment, since the printing and the carriage shift are carried out within a type-to-type movement period, a variation of load to the motor is large. The present embodiment is effective to reduce the variation of load to the motor.

Figure 6:
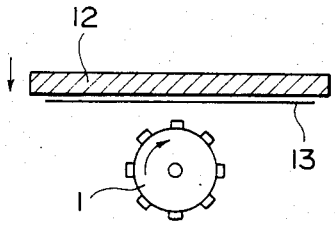

FIG. 6 shows other embodiment of the present invention, in which the print paper 13 is pressed to the type drum 1 by the platen hammer 12.

In the present embodiment, it is necessary to press the hammer while the type drum makes the rolling motion.

The other portions of the mechanism are identical to those of the first embodiment.

As is apparent from the above description, the present invention offers the following advantages:

(1) Since the carriage shift time and the print time are substantially equal, a high speed printing is attained.

(2) A relatively long time is permitted to press the type although the rotation of the drum is not stopped. Accordingly, imperfect print, ruffed printing and misalignment of characters are avoided and the ink is readily transferred. Therefore, a high quality of printing is attained.

(3) No clutch is required and a printer which is of simple construction, inexpensive and compact is provided.

In the above embodiments, the carriage shift mechanism comprises the rack teeth 8*a* of the type selection member 8 and the worm gear 6, and the type selection member 8 is moved by the solenoid, not shown. By jumping the rack tooth of the type selection member 8 relative to the worm gear 6 to engage therewith, the type drum which is integral with the worm gear is rolled and pressed by the pitch of the worm gear to print the character.

However, since this carriage shift mechanism moves the rack plate of a large mass, it needs a large solenoid and the size of the unit is large. In addition, since the rack plate is jumped into the worm gear, time is wasted and timing is difficult to attain. In some cases, the rack plate is kicked away and it is difficult to effect exact carriage shift.

It is, therefore, an object of the present invention to provide a printer having a carriage shift control mechanism which can positively carry out the carriage shift with a very simple construction.

In order to achieve the above object, in accordance with the present invention, a carriage shift control member includes a rack belt which meshes with a drum gear integral with a type drum, and a stop lever which meshes with the rack belt at a predetermined timing.

Figure 7:
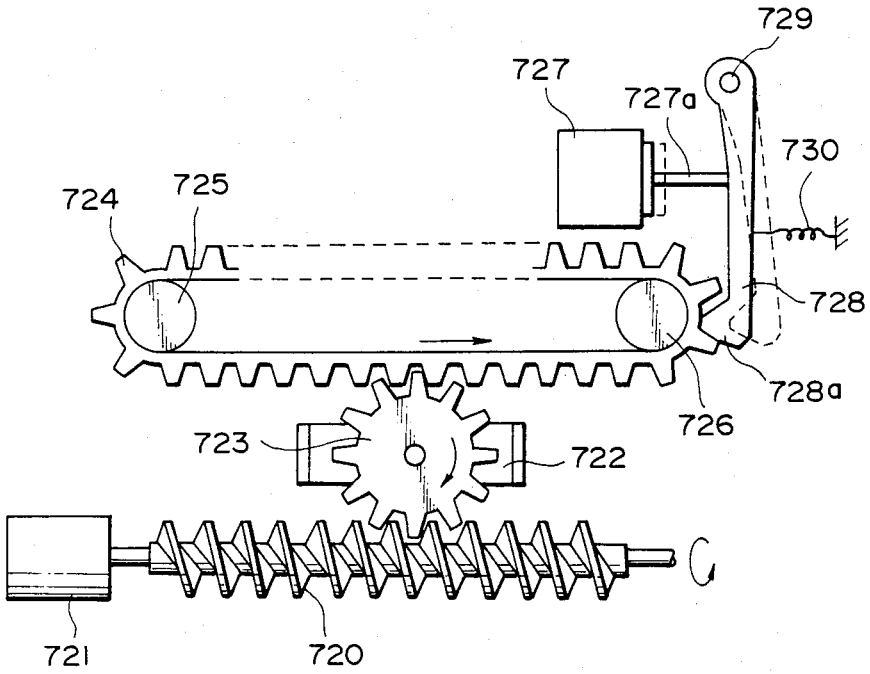
FIG. 7 shows one embodiment of the present invention.

FIG. 7 shows one embodiment of the present invention, in which numeral 720 denotes a worm shaft which is driven by a motor 721. A drum gear 723 which is integral with a type drum, not shown, mounted on a carriage 722 meshes with the worm shaft 720. The drum gear 723 is rotatably mounted to the carriage 722 and has teeth corresponding to types of the type drum and is rotated by the worm shaft 720.

On the other hand, on the opposite side of the drum gear 723 to the worm shaft 720, an endless rack belt 724 is spanned between rolls 725 and 726. Numeral 727 denotes a solenoid and a stop lever 728 is linked to an end of a rod 727*a* of the solenoid 727. One end of the stop lever 728 is pivotably supported by a stationary portion of the unit through a shaft 729 and an engaging portion 728*a* at the other end of the stop lever 728 is located at a position engageable with the rack belt 724. The stop lever 728 is imparted with a pivoting force by a spring 730 such that the engaging portion 28*a* is moved away from the rack belt 724.

The operation of the present embodiment thus constructed is now explained.

The drum gear 723 is rotated by the worm shaft 720 while it is supported by the carriage 722. When the tooth of the drum gear corresponding to the type to be printed of the type drum which is integral with the drum gear 723 meshes with the rack belt 724, the solenoid 727 is energized and the stop lever 728 is rotated clockwise as viewed in FIG. 7 and the engaging portion 728*a* engages with the rack belt 724.

As a result, the rack belt 724, which has been free running with the drum gear 723, is stopped, but since the drum gear 723 is still rotated by the worm shaft 720, the center of the drum gear 723, and hence the type drum (not shown) and the carriage 722 are moved in accordance with the pitch of the worm shaft 720 and the drum gear 723 rolls on the pitch circumference of the surface which contacts with the rack belt 724. At this time, the type on the type belt mounted on the type drum is projected by a hammer (not shown) so that the type is pressed to a print paper to print a character.

After the printing, the solenoid 727 is deenergized and the stop lever 728 is returned by the spring 730 so that the engaging portion 728*a* is disengaged from the rack belt 724. As a result, the rack belt 724 again starts to run and the drum gear 723 stops at a position and rotates at the stopped position to select a type to be next printed. The type selection operation and the carriage shift operation are repeated in the same manner to sequentially print characters.

As seen from the above, according to the embodiment of FIG. 7, a the rack belt which normally engages the drum gear which rotates the type drum and a stop lever which engages the rack belt by energizing the solenoid at the predetermined timing are provided. Accordingly, only the small and light stop lever is moved by the solenoid. Thus, the solenoid can be of small size and of low power consumption and the engaging time of the stop lever and the rack belt is reduced and hence a high speed printing can be attained.

Figure 8:
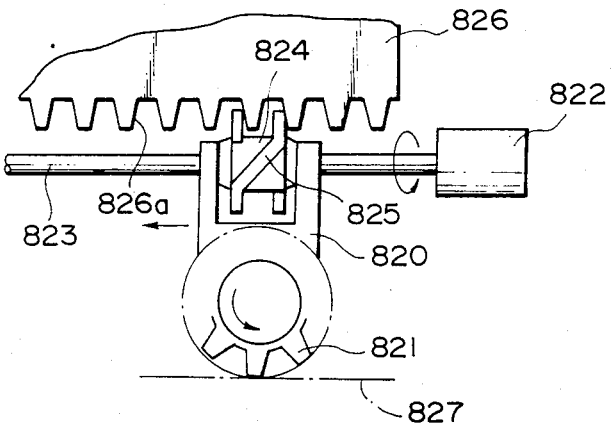
FIG. 8 shows another embodiment of the present invention.

FIG. 8 shows a further embodiment of the present invention, in which numeral 820 denotes a carriage on which a type drum 821 is rotatably mounted. The type drum 821 is rotated by a motor, not shown. The carriage 820 is axially, slidably mounted on a rotary shaft 823 which is rotated by a pulse motor 822. A rotating member 824 is mounted on the carriage 820. The rotating member 824 is formed with a worm gear 825 so that the rotating member 824 is slidable relative to the rotary shaft 823 and rotatable with the shaft 823.

The worm gear 825 of the rotating member 824 meshes with rack teeth 826*a* of a rack plate 826. Numeral 827 denotes a print plane.

The operation of the present embodiment thus constructed is now explained.

The type drum 821 is rotated by the motor, not shown, and when a type to be printed faces the print plane 827, the rotating member 824 is rotated one revolution by the pulse motor 822. The worm gear 825 of the rotating member 824 meshes with the rack teeth 827*a* so that the carriage 820 is moved in the direction of rotation of the type drum 821 by the pitch of the worm gear 825 of the rotating member 824.

By synchronizing the rate of movement of the carriage 820 with the rotational speed of the type drum 821, the type drum 821 rotates over the print plane 827 and the type is projected by the hammer, not shown, so that rolling printing is effected on the print paper.

In accordance with the embodiment of FIG. 8, since the rack teeth jump into the worm gear which is rotating at a high speed, the difficulties in engaging timing and kick-out which were encountered in the prior art mechanisms have been resolved and the carriage shift is positively effected.

As seen from the above, in accordance with the embodiment of FIG. 8, the rotating member having the worm gear is mounted on the carriage, the worm gear is normally meshed with the rack teeth and the rotating member is rotated by the pulse motor. Accordingly, unlike the prior art mechanism in which the rack teeth jump into the worm gear, the difficulty in the engaging timing is avoided and the carriage shift is positively effected. Thus, a printer having a simple carriage shift control mechanism is provided.

Figure 9A:
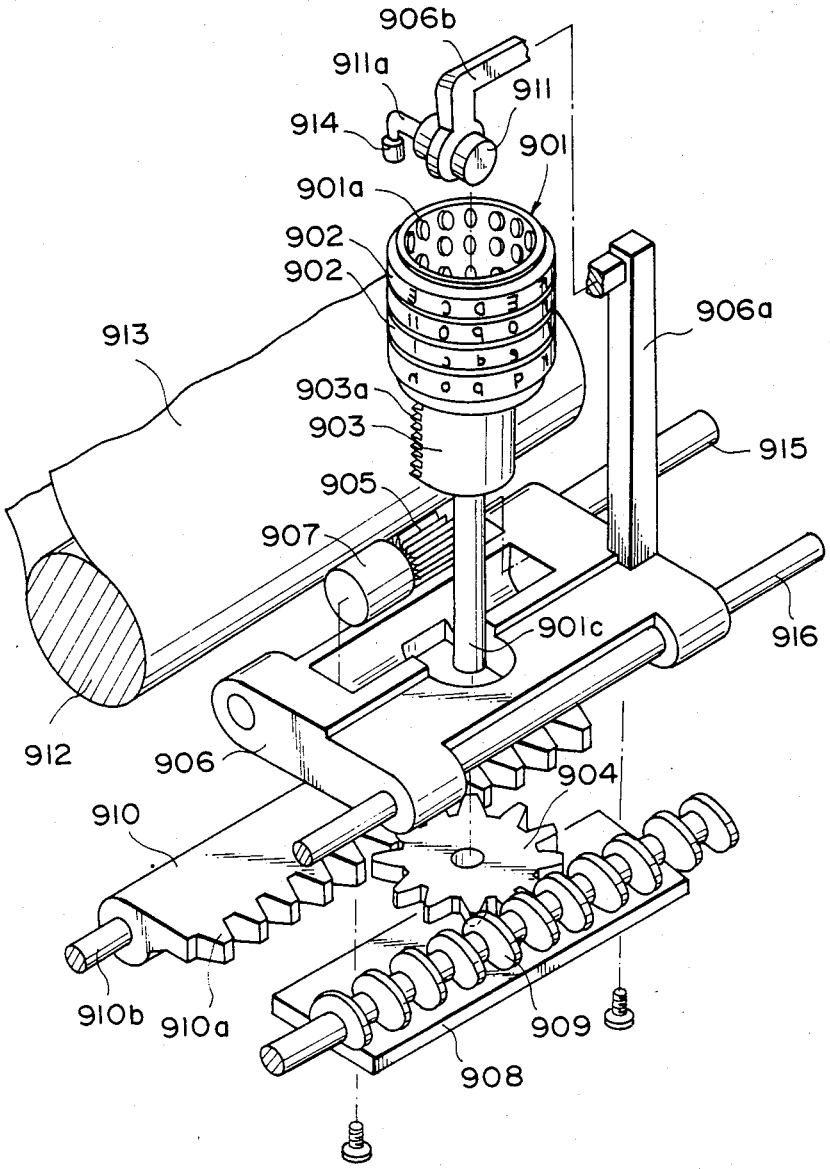
FIGS. 9A and 9B show other embodiment of the present invention.
Figure 9B:
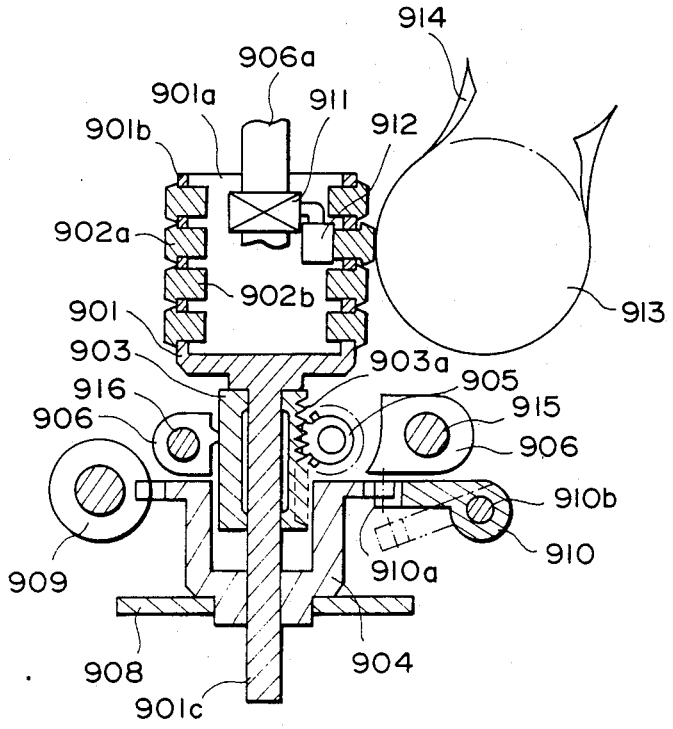

FIGS. 9A and 9B show a further embodiment of the present invention, in which numeral 901 denotes a type drum. A plurality of 901*b* are formed in a base 901*a* of the type drum 901 at a predetermined pitch circumferentially and vertically thereof, and the base 901*a* is oriented to be orthogonal to a direction of print line.

A plurality of type belts 902 are mounted on the type drum 901 and vertically spaced from each other. The type belts 902 are made of elastic material such as rubber, have types 902*a* on front surfaces thereof and projections 902*b* on rear surfaces thereof, which projections 902*b* are opposite to the types 902*a* and adapted to fit into the apertures 901*b*.

A support shaft 901*c* integrally and downwardly extends from a lower end of the base 901*a* of the type drum 901. The support shaft 901*c* is rotatably supported by a lift member 903 which is vertically movably mounted to a carriage 906. Rack teeth 903*a* are formed on a side of the lift member 903.

The carriage 906 is slidably fitted to horizontally arranged guide shafts 915 and 916. A pinion gear 905 which is rotated by a pulse motor 907 is mounted in a horizontal position on the carriage 906 and the pinion gear 905 meshes with the rack teeth 903*a*.

A post 906*a* vertically extends from one end of the carriage 906 and a bent portion 906*b* at an upper end thereof extends above the base 901*a*, and a solenoid 911 is mounted at an end of the bent portion 906*b* to extend into the base 901*a*. A hammer roll 914 is mounted at an end of a plunger 911*a* of the solenoid 911 to face to the rear projections 902*b* of the type belts 902.

A lower end of the support shaft 901*c* is affixed to a drive gear 904 which is rotatably supported by a base 908 which is integral with the carriage 906. The drive gear 904 meshes with a worm shaft 908 which is rotated by a motor not shown, to rotate the type drum 901 through the support shaft 901*c*.

A rack plate 910 is arranged on the opposite side of the drive gear 904 to the worm shaft 909. The rack plate 910 has one side edge thereof rotatably supported by the support shaft 910*b* and rack teeth 910*a* are formed on the other side edge. The rack plate 910 is displaced by a solenoid, not shown, between an meshing position with the drive gear 904 and a disengaged position shown by a chain line. Numeral 912 denotes a platen and numeral 913 denotes a print paper.

The operation of the present embodiment thus constructed is now explained.

The type belt is selected by rotating the pulse motor 907 to rotate the pinion gear by a given amount and vertically move the lift member 903 through the rack teeth 903*a* so that the type drum 901 is vertically moved to bring the desired type belt between the hammer roll 914 and the print paper 913.

The type is selected by energizing the solenoid (not shown) to rotate the rack plate 910 relative to the teeth of the drive gear 904 corresponding to the desired type so that the rack teeth 910*a* mesh therewith. The drive gear 904 meshed with the rack teeth 910*a* of the rack plate 910 is moved in the direction of the carriage shift by the pitch of the worm shaft 909. As a result, the drive gear 904 rolls on the pitch circumference and the type drum 901 which is integral with the drive gear 904 also rolls. Simultaneously therewith, the solenoid 911 is energized to project the type 902*a* by the hammer roll 914 so that the type is rolled on and pressed to the print paper placed to contact the pitch circumference of the drive gear 904. Since the ink is transferred to the type 902*a* by the ink roll, not shown, the character is printed on the print paper 913. After one tooth of revolution of the drive gear 904, the solenoid is deenergized to disengage the drive gear 904 from the rack plate 910 so that the drive gear 904 and hence the type drum stop moving and the type drum 901 continues to rotate for the selection of the type to be next printed.

The above operation is repeated to sequentially print one line of characters. Then, the carriage 906 is returned to the initial position and the paper is shifted by one line space. The same operation is repeated to print lines of characters.

As seen from the above, in accordance with the present embodiment, the type drum having the plurality of type belts on the outer periphery thereof is provided. Therefore, a printer having a large number of types can be provided with a simple construction.

Figure 10:
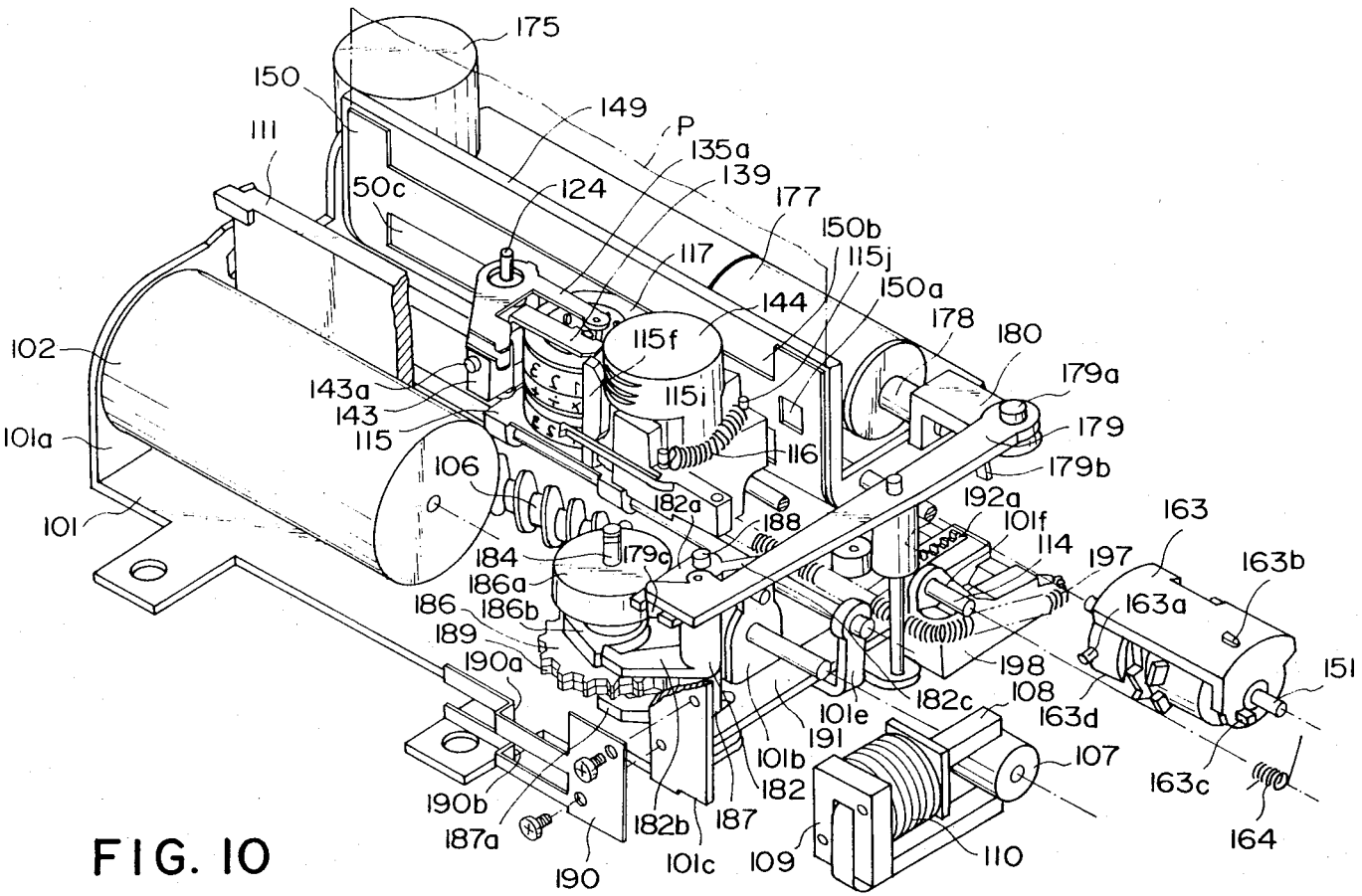
Figure 11:
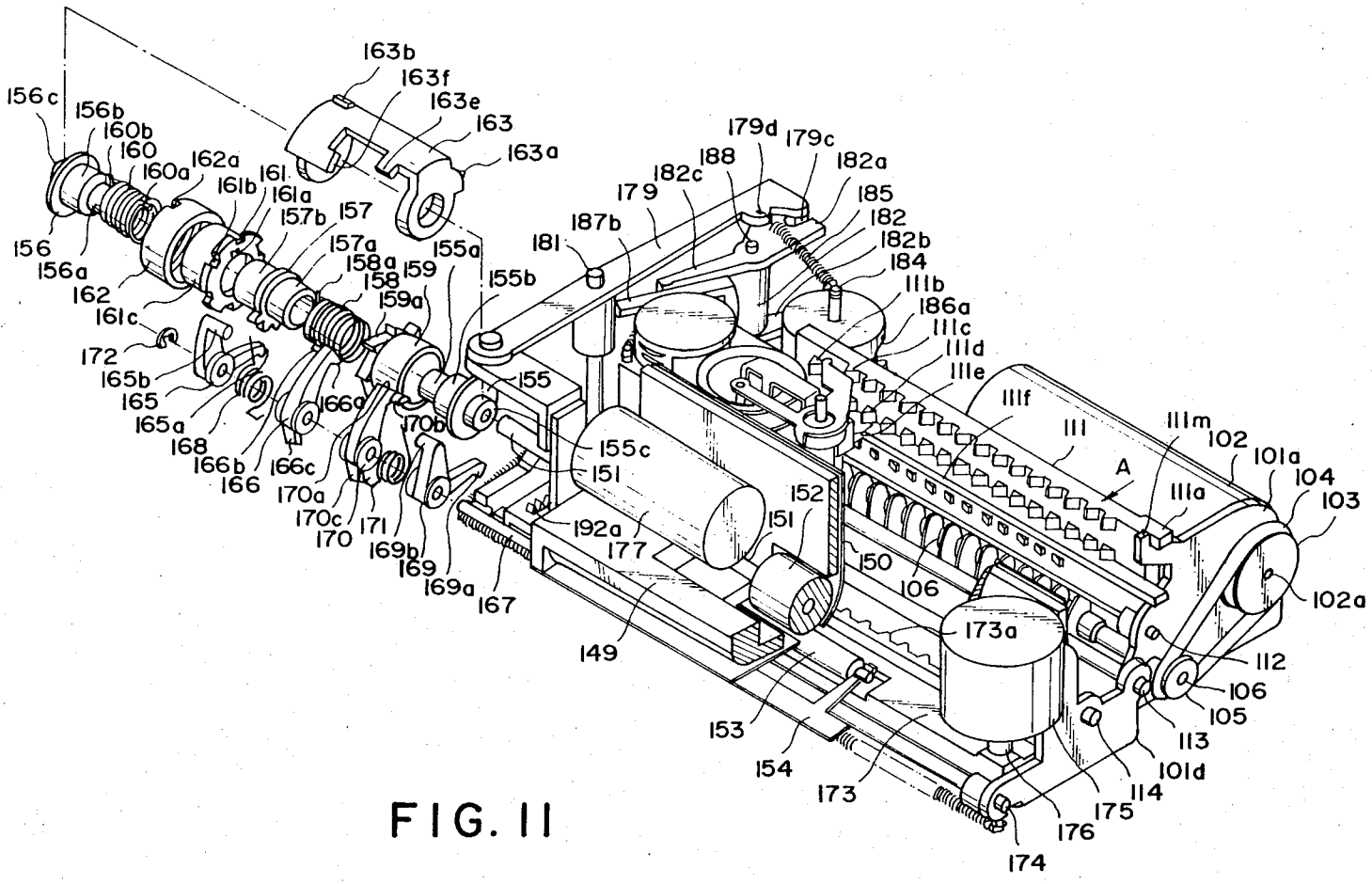

FIGS. 10–18 show a still further embodiment of the present invention, in which numeral 101 denotes a base plate, and a motor 102 is mounted on a side plate 101*a* which extends from one side edge of the base plate 101. As shown in FIG. 11, an output shaft 102*a* of the motor 102 extends outward of the side plate 101*a* and a pulley 103 is fixed thereto.

On the other hand, a worm shaft 106 is rotatably supported between the side plates 101*a* and 101*b* in parallel to the motor 102. A pulley 105 is fixed to an outer end of the worm shaft 106 facing to the side plate 101*a*, and a belt 104 is spanned between the pulley 105 and the pulley 103 to transmit the rotation of the motor 102.

As shown in FIG. 10, a cylindrical magnet 107 is fixed to the other end of the worm shaft 106. The magnet 107 has an N pole and an S pole at opposite positions on the outer periphery thereof. A U-shaped yoke 108 is arranged to sandwich the magnet 107, and a coil 110 is mounted on the yoke 108 through a bobbin 109. The magnet 107 and the yoke 108 having the coil 110 mounted thereon form a tacho-generator so that a sinusoidal e.m.f. is generated in the coil 110 as the magnet 107 rotates. In the present embodiment, the induced sinusoidal e.m.f. is shaped to produce a pulsive timing signal (TP signal).

A hammer plate 111 is arranged in the motor 102 and it is rotatably supported between the side plates 101*a* and 101*b* through a shaft 112 which extends from opposite lower ends thereof. An upper end of the hammer plate 111 is urged by a spring (not shown) in the direction to move away from the motor 102. A projection 111*a* is formed at one end of the hammer plate 111. It engages with a bent portion 111*m* formed at an end of the side plate 101*a* to restrict the pivotal rotation of the hammer plate 111 from the motor 102.

A projection 111*b* for effecting character position printing is formed on an inner side at the opposite end of the hammer plate 111 to the projection 111*a*, and fifteen black printing projections 111*c* and fifteen red printing projections 111*d* are formed horizontally on the inner side of the hammer plate 111 above and below the projection 111*b*. A cam 111*e* for shifting a print hammer to be described later is formed under the red printing projection 111*d* at a position close to the projection 111*b*, and a guide plate 111*f* for holding a shift position of the print hammer horizontally projects under the red printing projection 111*d*. Sixteen projections 111*g* for stopping the carriage are horizontally arranged on the inner side of the hammer plate 111 under the guide plate 111*f*.

Figure 12A:
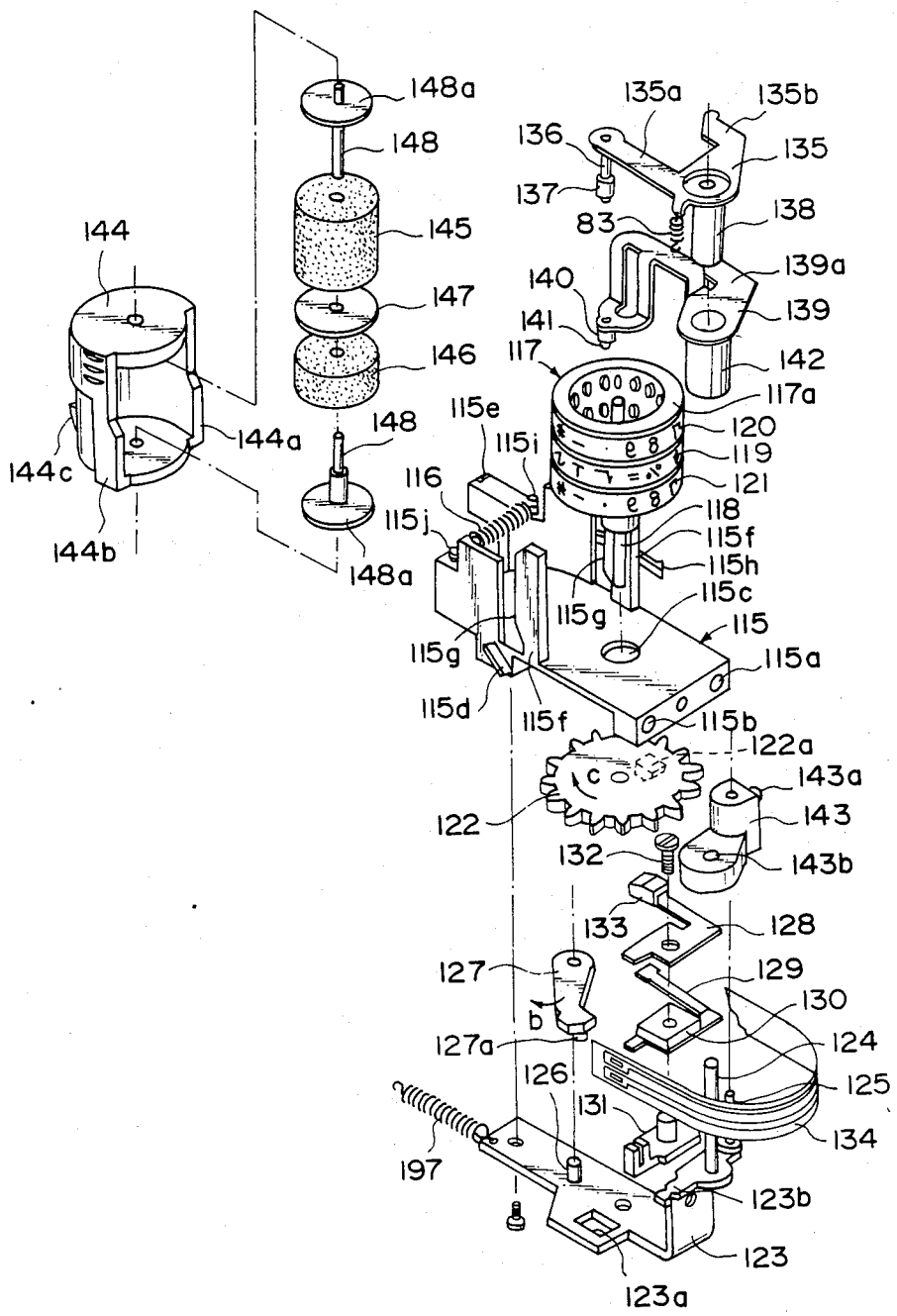
FIGS. 12A and 12B show developed perspective views of a carriage and a paper feed unit.
Figure 12B:
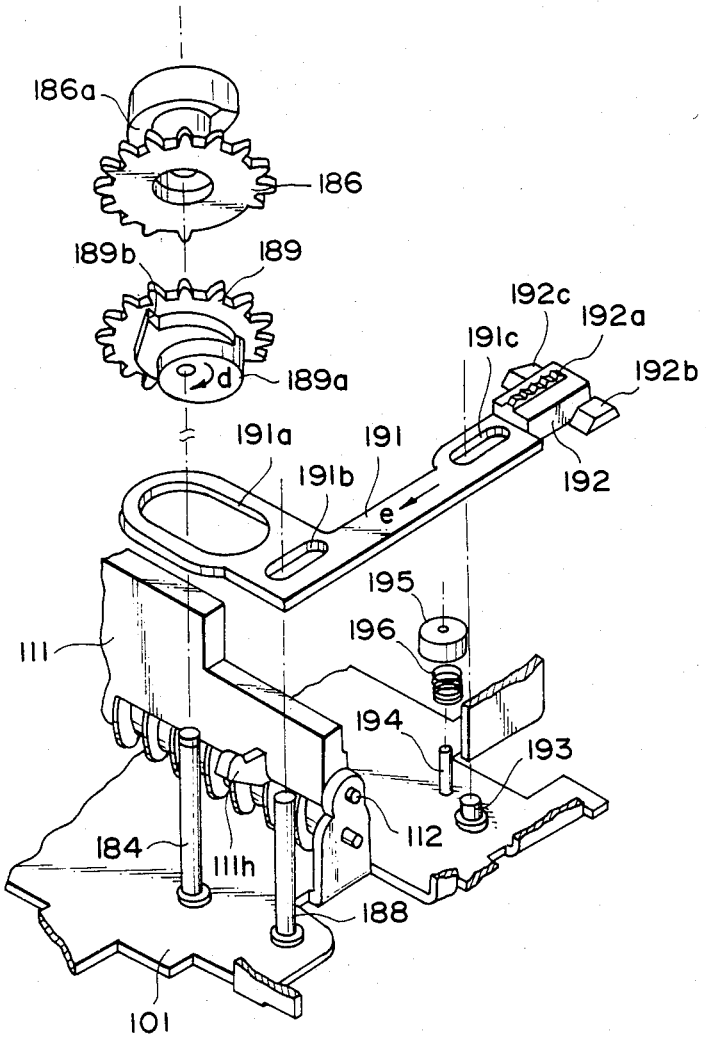

As shown in FIG. 12B, an arm 111*h* for rotating the hammer plate 111 in the direction away from the motor 102, that is, in the direction of an arrow A when the carriage is returned is arranged on the outer side of the hammer plate 111 at a position close to the projection 111*b*.

Guide bars 113 and 114 are horizontally arranged in parallel to the hammer plate 111 on the inner side of the hammer plate 111 between the side plates 101*d*, 101*e* and 101*f* of the base plate 101.

A carriage 115 shown in detail in FIG. 12A is mounted on the guide bars 113 and 114. The carriage 115 has apertures 115*a* and 115*b* formed in the bottom thereof, to which the guide bars 113 and 114 are slidably fitted, and an aperture 115*c* formed in the bottom plate thereof, to which a shaft 118 extending from the lower end of the type drum 117 is fitted.

A cam 115*d* for switching a control cam for controlling the print paper feed obliquely extends from one side of the carriage 115, and a projection 115*e* for actuating a paper feed clutch to be described later is formed at a projecting end of the carriage 115.

Guide plates 115*f* extend upward on the opposite sides of the carriage 115 and cams 115*g* are formed on the sides of the carriage 115 which face to the cam 115*d*.

Pins 115*i* and 115*j* extend from the carriage 115 and a spring 116 for supporting an ink roll case is spanned between the pins 115*i* and 115*j*.

The type drum 117 has a cylindrical base 117*a* and is arranged such that an axis thereof is orthogonal to the direction of printing. A black printing type belt 120 is mounted on an upper outer periphery of the type drum 117, a black printing symbol type belt 119 is mounted on a middle outer periphery, and a red printing type belt 121 is mounted on a lower outer periphery.

A carrier stop pawl 115*h* which engages with the projection 111*a* of the hammer plate 111 is formed on the opposite side edge of the carriage 115 to the cam 115*d*.

A shaft 118 extending from the lower end of the cylindrical base 117*a* of the type drum 117 is fixed to a drum gear 122 positioned under the carriage 115, through the aperture 115*c* of the carriage. The drum gear 122 has the same number of teeth as the number of types of the type belt mounted on the type drum 117 and has a projection 122*a* on the bottom surface thereof, which is used to generate a reset signal to detect an initial position of the types.

Numeral 123 in FIG. 12A denotes a carrier attached to a lower side of the carriage 115. The carrier 123 is integral with the carriage 115 and has a hammer shaft 124, a guide shaft 125 for hammer shift and a shaft 126 for supporting a rack plate control lever, which extend vertically. Numeral 127 denotes the rack plate control lever having one end thereof rotatably supported by the shaft 126 and it is normally applied with a rotating force in a clockwise direction or a direction of an arrow b by a spring, not shown. A positioning pin 127*a* extends from a lower side of a free end of the rack plate control lever 127 and it is fitted into an opening 123*a* formed in the carrier 123 so that pivotal movement thereof is restricted within the opening 123*a*.

A movable contact 128 and a stationary contact 129 are mounted on the carrier 123 by a screw 132. They are fixed to a mount 131 by the screen 132 with an insulating plate 130 being interleaved therebetween. A contact cam 132 is fixed at an end of the movable contact 128 and contacts to the projection 122*a* of the drum gear 122 so that it is urged to the stationary contact 129 to establish an electrical conduction therebetween. Since the stationary contact 129 and the movable contact 128 contact each other once in the positional rotation of the drum gear 122, the signal TR described above can be taken out therefrom.

Numeral 134 denotes a flexible printed circuit board having one end thereof soldered to terminals of the movable contact 128 and the stationary contact 129 and the other end thereof connected to terminals (not shown) arranged on the base. Thus, the signal TR is always taken out during the movement of the carriage.

Numeral 135 denotes a black printing hammer which is of generally L-shape. A hammer roll 137 is rotatably supported by one arm 135*a* of the hammer 135 through a roll shaft 136 and the other arm 135*b* is positioned to contact the print projections 111*b* and 111*c* of the hammer plate 111. A cylindrical bearing 138 is fixed to the base of the black printing hammer 135. The bearing 138 is rotatably and slidably fitted to the hammer shaft 124. A red printing hammer 139 is mounted coaxially with the black printing hammer 135. The red printing hammer 139 is constructed similarly to the black printing hammer 135 and a hammer roll 140 is rotatably fitted to a roll shaft 141 at an end of one arm of the hammer 139 and the other arm 139*a* is positioned to be engageable with the projection 111*d* of the hammer plate 111. A cylindrical bearing 142 is fixed to the base of the red printing hammer 139 and the bearing 138 of the black printing hammer 135 is rotatably fitted to the bearing 142.

A hammer shift lever 143 is rotatably fitted to the hammer shift lever shaft 125. One end of the hammer shift lever 143 projects toward the shaft 124 which is fitted into an aperture 143*b* formed in the one end of the hammer shift lever 143. Accordingly, the hammer shift lever 143 cannot rotate but it is axially slidable. A shifting projection 143*a* is formed on an outer side of the base of the hammer shift lever 143. The projection 143*a* engages with the cam 111*e* formed on the hammer plate 111 and slides on the cam 111*e* to shift up the black printing hammer 135 and the red printing hammer 139. The lower ends of the bearings 138 and 142 of the black printing hammer 135 and the red printing hammer 139 are mounted on the projection of the hammer shift lever 143 in which the aperture 143*b* is formed.

A return spring 183 for returning the carrier by a shift distance is spanned between the base end of the black printing hammer 135 and a spring hook 123*b* formed at one end of the carrier 123 so that the black printing hammer 135 is normally biased to move downward.

An ink roll case 144 is detachably fitted to a space between the spring 116 of the carriage 115 and a pair of guide frames 115*f*. The ink roll case 144 is opened on a side facing to the type drum 117, and cams 144*a* and 144*b* which are complementary to the cams 115*g* of the guide frames 115*f* are formed on the open side. A recess 144*c* is formed on an outer side of the ink roll case 144 orthogonal to an axial line of the ink roll case 144, and the spring 116 fixed to the carriage 115 is fitted thereto.

The ink roll case 144 contains a black ink roll 145 and a red ink roll 146. Shafts 148 having flanges 148*a* are arranged axially in the ink roll case 144 and the black and red ink rolls 145 and 146 are rotatably supported by the shafts 148 with a spacer 147 being interleaved therebetween. The shafts 148 are constructed to permit mutual fitting so that the ink rolls 145 and 146 can be readily removed. The ink roll case 144 which contains the ink rolls 145 and 146 is mounted on the carriage 115. When it is mounted or removed, the ink rolls 145 and 146 do not contact the type belts 119–121 of the type drum 117 except when it is completely mounted because the cams 144*a* and 144*b* and the cams 115*g* of the guide frames 115*f* are complementary to each other, and the ink rolls contact the type drum only when the complementary cams perfectly engage. Under this condition since the spring 116 is fitted to the recess 144*c* of the ink roll case 144, the ink rolls 145 and 146 are urged to the type drum 117 and the axial movement thereof is restricted so that they are positively mounted. Accordingly, when the ink roll case 144 is mounted or removed, the black and red printing ink rolls 145 and 146 do not contact the type belts 119–121 and the inks are not mixed. A platen 149 is arranged on the side of the carriage 115 opposite to the hammer plate 111. The platen 149 has a generally L-shaped cross section and a paper guide 150 for guiding a print paper P is arranged in a spaced relation to the platen 149. An opening 150*a* for printing a symbol is formed in the paper guide 150, as shown in FIG. 10, at a position close to the magnet 107 of the tacho-generator, a black character printing opening 150*b* is formed at an upper end, and a red character printing opening 150*c* is formed adjacent to the opening 150*b*. A rubber roll 152 is arranged near the platen 149 to feed the print paper P. A shaft 151 of the rubber roll 152 extends outwardly beyond the side plate of the base 101 as shown in FIG. 11.

The rubber roll 152 extends downwardly through an opening formed in the bottom of the platen 149 and a pinch roll 153 is rotatably mounted to oppose the rubber roll 152. The pinch roll 153 is supported by a leaf spring 154 so that it is normally urged toward the rubber roll 152.

Bosses 155 and 156 for transmitting a paper feed driving force are fixed to the outer ends of the shaft 151 of the rubber roll 152. A gear 157 is rotatably supported by boss portions 155*a* and 156*a* of the bosses 155 and 156. A clutch spring 158 is wrapped across a boss portion 157*a* of the gear 157 and a large diameter portion 155*b* of the boss 155. Numeral 159 denotes an advancing feed pawl which is mounted on the outer side of the clutch spring 158 with a hook 158*a* of the clutch spring 158 being hooked to a groove, not shown. A ratchet wheel 159 has eight ratchets 159*a* formed circumferentially at an equi-angular interval to define a paper feed distance.

Another clutch spring 160 is wrapped across the other boss portion 157*b* of the gear 157 and a large diameter portion 156*b* of the boss 156. A ratchet wheel 161 for reversely feeding the print paper is mounted on the outer side of the clutch spring 160. It is mounted on the outer side of the clutch spring 160 with a hook 160*a* of the clutch spring 160 being hooked to a notch 161*a* of the ratchet wheel 161. The ratchet wheel 161 has six notches 161b formed circumferentially at an equi-angular interval to define a reverse feed distance of the print paper. A color 162 is press-inserted into the boss portion 161c. The color 162 has a notch 162a to which a hook 160b of the clutch spring 160 is hooked. The ratchet wheel 161 and the color 162 are positioned and mounted such that the notches thereof engage with the hooks 160a and 160b of the wrapped clutch spring 160, and they are mounted on the outer side of the clutch spring 160.

The ratchet wheels 159 and 161, the bosses 155 and 156 and the clutch springs 158 and 160 form so-called spring clutchs, and a paper feed control cam 163 is mounted on the outer side thereof as shown in FIG. 10. The control cam 163 has a switch pin 163a on a side thereof to engage with a cam 115d to switch the carriage 115, and a stop member 163b on an upper surface thereof to hold the switched position. A projection 163c for hooking a spring is formed on the side of the control cam 163 and one end of a control cam spring 164 shown in FIG. 10 is engaged with the projection 163c. The control cam 163 has a projection 163d under the switch pin 163a. The projection 163d serves to press a stopper to be described later. Numerals 163e and 163f denote cams for switching the print paper feed direction between forward direction and backward direction.

A shaft 167 extends from the platen 149 in parallel to the shaft 151 of the rubber roll 152, and a reverse feed cam lever 165 and a reverse feed lever 166 are rotatably supported by the shaft 167. The reverse feed cam lever 165 has a lever 165a which extends below the spring clutch and a pin 165b on the other arm thereof which extends toward the platen 149 in parallel to the shaft 167. The reverse feed lever 166 has a pawl 166a at one end thereof which engages with the notch 161b of the ratchet wheel 161, a projection 166b which engages with the cam portion 163f of the control cam 163, and a downwardly extending arm 166c to which a spring is hooked. Numeral 168 denotes a spring for the reverse feed lever 166, which is mounted on the shaft 167 between the reverse feed cam lever 165 and the reverse feed lever 166 and has its one end hooked to the pin 165b and the other end hooked to the arm 166c. The pin 165b of the reverse feed cam lever 165 and the reverse feed lever 166 are brought into contact by the force of the spring 168 and they are normally moved in union by the urging force of the spring 168.

A forward feed cam lever 169 and a forward feed lever 170 are mounted on the shaft 167. Like the reverse feed cam lever 165, the forward feed cam lever 169 has a lever 169a and a pin 169b, and like the reverse feed lever 166, the forward feed lever 170 has a pawl 170a, a projection 170b and an arm 170c to which a spring is hooked. A forward feed lever spring 171 is mounted on the shaft 167 between the levers 169 and 170, and one end of the spring 171 is hooked to the pin 169b and the other end thereof is hooked to the arm 170c so that the pin 169 contacts to the arm of the forward feed lever 170 and move in union therewith by the urging force of the spring 171. Numeral 172 denotes an E-ring which prevents drop-out of the levers.

A printing rack plate 173 is arranged on the base 101. The rack plate 173 is rotatably supported through a shaft 174 and has rack teeth 173a which mesh with the drum gear 122. A print solenoid 175 is arranged on the base 101. By energizing the solenoid 175, a plunger 176 is attracted to pull up a rack plate 173 linked to an end of the plunger 176 so that the rack teeth 173a are lifted up to mesh with the drum gear 122.

A paper feed solenoid 177 is arranged on the platen 149 to face to the solenoid 175. By energizing the solenoid 177, a plunger 178 is attracted. A boss portion 179a of a pivotal lever 179 is rotatably coupled to a end of the plunger 178 through a lever 180.

The pivotal lever 179 has its intermediate portion rotatably supported by a shaft 181, and a projecting member 179b which engages with the stop member 163b of the control cam 163 is formed on the lower surface of the lever 179 closer to the boss 179a. A pin 179c extends downwardly from the free end of the lever 179 and it engages with a shift-back lever 182 to be described later. The shift-back lever 182 is rotatably supported by a shaft 188 extending from the base 101, and the pin 179c is rotatably fitted to a notch formed at one end 182a of the shift-back lever 182. The shift-back lever 182 has an arm 182c which extends below the pivotal lever 179.

An arm 182b which engages with a clutch to be described later is formed at the lower end of the shift-back lever 182.

A shaft 184 extends near a shaft 188, which supports the shift-back lever 182, perpendicularly to the substrate 101. A spring 185 is spanned between the shaft 184 and a spring hook 179d at the free end of the pivotal lever 179 so that the pivotal lever 179 is normally biased clockwise around a shaft 181 shown in FIG. 11.

As shown in FIGS. 10 and 12B, a shift-back clutch gear 186 which is integral with a cam 186a is mounted on the shaft 184 and a hook 186b is formed integrally with the gear 186. A paper feed clutch gear 189 is coaxially mounted under the shift-back clutch gear 186, and a hook 189b and an eccentric cam 189a are integrally formed on the lower surface of the paper feed clutch gear 189.

The hook 186b of the shift-back clutch gear 186 is engaged with the arm 182b of the shift-back lever 182 and the hook 189b of the paper feed clutch gear 189 is engaged with the arm 187a of the paper feed gear lever 187 coaxially supported.

The hook 186b of the shift-back clutch gear 186 is engaged with the arm 182b of the shift-back lever 182 and the hook 189b of the paper feed clutch gear 189 is engaged with an arm 187a of a paper feed gear lever 187 which is supported by a shaft 188 coaxially with the shift-back lever 182. The other arm of the paper feed gear lever 187 extends to the vicinity of an arm 182c of the shift-back lever 182 as shown in FIG. 11 and they are in engaging relation. An arm 187b is positioned to be engageable with a projection 115e formed at one end of the carriage 115.

A leaf spring 190 is fixed at the vicinity of the clutch gear 186 and the paper feed clutch gear 186 by a rising portion 101c of the base 101, and two bent portions 190a and 190b extending from the leaf spring 190 press the hooks 186b and 189b, respectively. However, when the arms 182b and 187a of the shift-back lever 182 and the paper feed lever 187 and the hooks 186b and 189b are in engagement as shown in FIG. 10, the clutch gears do not rotate although the hooks are pressed by the bent portion 190a and 190b of the leaf spring 190.

Since the shift-back clutch gear 186 has two teeth removed which engage with a worm of the worm shaft 106 as shown in FIG. 12B, a rotational force is normally not transmitted to the gear 186. Since the paper feed clutch gear 189 has also two teeth removed, it normally does not transmit the rotational force from the worm shaft 106.

A rack plate 191 is arranged under the paper feed clutch gear 189. The rack plate 191 is of generally L-shape as shown in FIG. 12B and an oval opening 191*a* is formed at one bent end. The eccentric cam 189*a* is fitted into the opening 191*a*. The rack plate 191 is formed with slots 191*b* and 191*c* at a linear portion thereof, and the shaft 188 and a pin 193 which extends from the base 101 are slidably fitted to the slots 191*b* and 191*c* to guide the linear movement of the rack plate 191. A rack portion 192 is integrally formed on the other side of the rack plate 191 and rack teeth 192*a* are formed on an upper surface thereof. Cams 192*b* and 192*c* which engage with the arm 165*a* of the reverse feed cam lever 165 and the arm 169*a* of the forward feed cam lever 169, respectively, are formed on both sides of the rack plate 191. A shaft 194 extends from the vicinity of the pin 193 extending from the base 101, and a stop color 195 is slidably fitted to the shaft 194 and it is normally urged upward by a spring 196.

Numeral 197 denotes a carriage return spring having its one end linked to the carrier 23 which is integral with the carriage 115 and its other end hooked to a hook, not shown, of the base 101. It is guided by a spring guide 198 to normally pull the carriage 115 to a home position.

Figure 13:
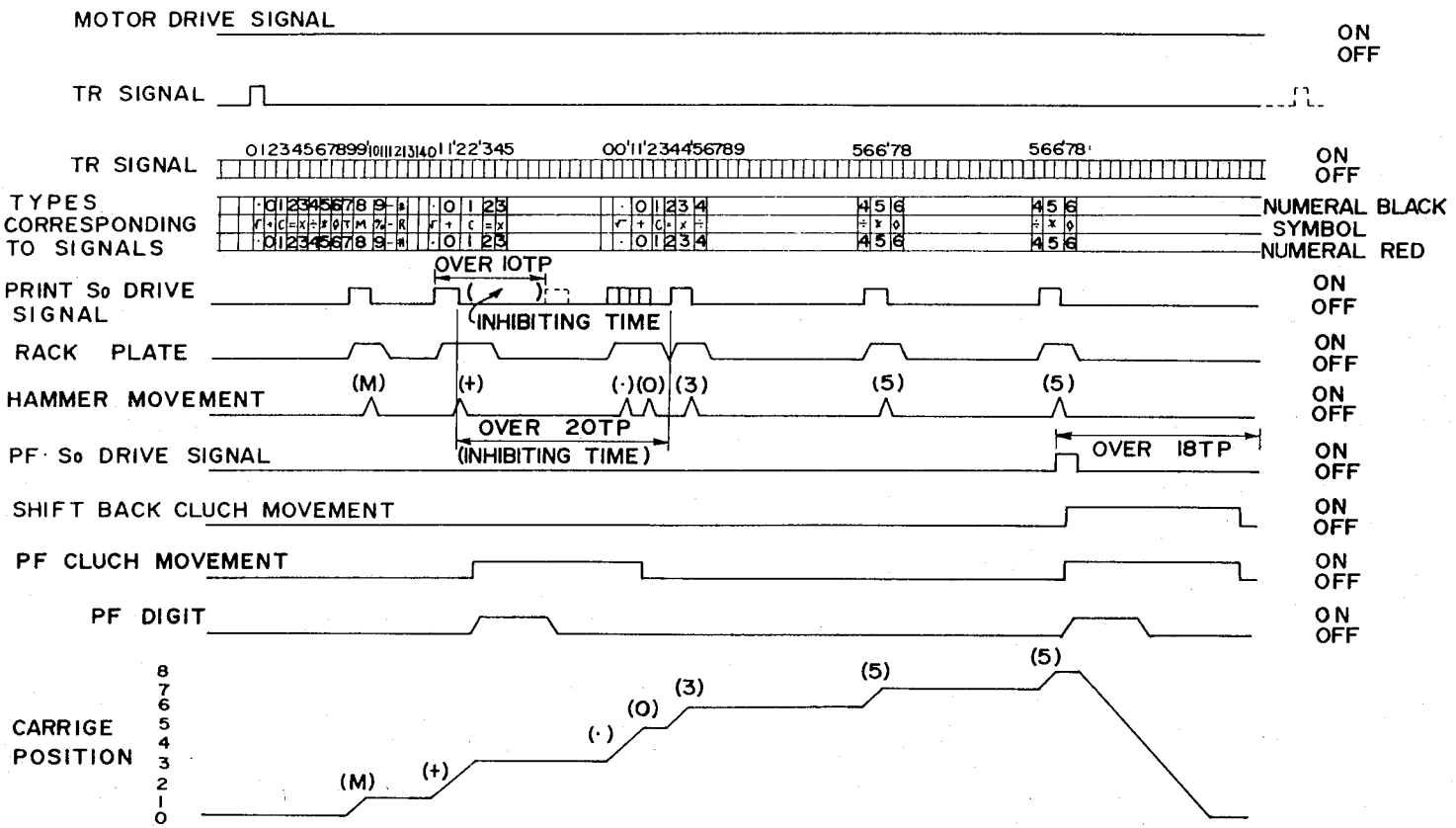

The operation of the present embodiment thus formed is now explained with reference to a timing chart of FIG. 13. FIG. 13 illustrates the printing of "5530+m" by black color.

When the motor 102 is energized upon a print instruction, the rotation thereof is transmitted through the output shaft 102*a*, the pulley 103, the rubber belt 104 and the pulley 105 so that the worm shaft 106 starts to rotate. As the worm shaft 106 rotates, the magnet 107 also rotates so that a sinusoidal e.m.f. is induced in the coil 110 of the tacho-generator. This e.m.f. is shaped to produce the timing signal TP. The worm shaft 106 meshes with the drum gear 122 so that the drum gear 122 is rotated in the direction of the arrow c in FIG. 12A as the worm shaft 106 rotates. When the worm shaft 106 rotates one revolution, the drum gear 122 rotates by one tooth angle. Since the teeth of the drum gear 122 correspond to the types, the drum gear 122 is rotated by one type pitch as the worm shaft rotates one revolution.

The projection 122*a* is formed on the rear surface of the drum gear 122 and it depresses the movable contact 128 once for each revolution of the drum gear 122 so that one reset signal TR per revolution is taken out. By combining the signal TR and the timing signal TP, the type position can be determined.

A desired character (including a symbol) is searched through a keyboard by the control circuit by counting the signal TP, and when the character to be printed is found, the solenoid 175 is energized. The signal TR and the type correspond in a manner shown in FIG. 13. When the solenoid 175 is energized, the plunger 176 is attracted and the rack plate 173 linked thereto is rotated around the shaft 174 so that the rack teeth 173*a* are moved up to start to engage with the drum gear 122. Since the rotational force is still acting on the drum gear 122 through the worm shaft 106, the drum gear 122 moves its center position relative to the stationary rack teeth 173*a* to start to move away from the home position, which is at right-hand in FIG. 10, that is, at the symbol printing opening 150*a* of the paper guide 150. Since the drum gear 122 is integral with the carriage 115, the carriage 115 starts to move and the control lever 127 also starts to move. Since the rack teeth 173*a* are in the lifted position, the control lever 127 goes under the rack teeth 173*a*. Accordingly, even if the solenoid 175 is deenergized, the rack teeth 173*a* do not descend because the control lever 127 is under the rack teeth 173*a*. Accordingly, the drum gear 122 and the rack teeth 173*a* are kept meshed. Since the portion of the rack teeth 173*a* which corresponds to the symbol digit printing portion has no tooth formed but has a thin plate leading to the next tooth, the drum gear 122 slides by two teeth angle of the rack teeth 173*a*. After the drum gear 122 has slid by two teeth angle, the control lever 127 is brought between the rack teeth so that the rack teeth 173*a* can descend to disengage from the drum gear 122.

As a result, the drum gear 122 stops to move the center thereof and the carriage 115 merely rotates at the stopped position.

On the other hand, when the carriage 115 starts to move with the drum gear 122, the arm 135*b* of the black character printing hammer 135 rides over the symbol printing projection 111*b* of the hammer plate 111. As a result, the arm 135*a* is rotated toward the platen and the hammer roll 137 rolls on the rear projection of the symbol printing type belt 119 and presses it so that the type is urged to the print paper P. Since the black ink is now transferred to the type surface of the type belt 119 by the black ink roll 145, the desired character is printed in black on the print paper P. The hammer roll 137 slightly presses the rear projections of the types adjacent to the printed type but side printing is not effected because the type belt is projected arcuately. By arranging the print paper P such that it is placed on a pitch circle of the drum gear 122, the type to be printed rolls on the print paper P so that the character is not rubbed even if the pressing time of the hammer 135 is slightly long.

As the carriage further moves and the arm 135*b* of the hammer lever 135 rides over the projection 111*b*, the hammer roll 137 stops the pressing and the type is returned to the original position by an elastic force of the type belt itself.

In the symbol digit printing, the printing is not effected because the spacing is continuously effected, and the black character printing hammer 135 is not moved because the hammer plate 111 does not have the corresponding projection, but the carriage is moved by additional one character pitch. In the spacing operation, the shifting projection 143*a* of the hammer shift lever 143 engages with the cam 111*e* of the hammer plate 111 and rides over it. As a result, the hammer shift lever 143 is shifted up by a predetermined amount. As a result, the hammers 135 and 139 are also shifted by a predetermined amount. At this time, the hammer roll 137 has been shifted to a position facing toward the rear projection of the black character printing type belt 120. The hammer roll 140 is at a position facing toward the symbol belt 121. At this time, the arm 135*b* of the hammer 135 is at a position to engage with the black character printing projection 111*c* and the red character printing hammer 139 is between the black character printing projection 111*c* and the red character printing projection 111*d*. As a result, the red character printing hammer 139 is not moved even if the carriage slides.

In order to print characters on the same print line, it is necessary to feed the print paper forwardly the same distance as the shift amount of the hammer. The paper feed operation will be described later.

After the print paper has been fed forwardly by the predetermined amount, a desired one of numeric digits to be next printed is selected. Like the symbol printing, the solenoid 175 is energized and the character is printed in the same principle as described above. Since the teeth of the rack teeth 173*a* are separated one by one, the control lever 127 goes into the space between the teeth as the carriage slides by one character pitch so that the binding of the rack teeth 173*a* is released and the printing is completed. In this manner, the characters are sequentially printed. In the present print example of "5530+m", the characters are sequentially printed starting from the symbol digit m.

When the control lever 127 disengages and the rack plate 173 moves down to disengage from the drum gear 122, the force to move the carriage 115 terminates and the carriage 115 tends to be returned by the carriage return spring 197, but since the stop pawl 115*h* on the carriage 115 engages with the projection 111*g* on the hammer plate 111, the type drum 117 rotates at the engaged position.

After all of the desired characters have been printed, the shift-back solenoid 177 is energized and the carriage 115 is returned to the home position by the carriage return spring 197. This operation will be described later. After one line of characters have been printed, the carriage 115 is shifted by a predetermined pitch in the forward direction of the print paper and the print cycle is completed.

The operation of the paper feed mechanism is now explained.

The worm shaft 106 and the shift-back clutch gear 186, and the paper feed clutch gear 189 form gear clutches which cut off the transmission of motive power at the non-toothed areas. They are of substantially same construction. The paper feed clutch gear 189 is explained here.

After the desired character has been printed, the paper feed solenoid 177 is energized and the plunger 178 is attracted. Thus, the pivotal lever 179 is rotated counterclockwise in FIG. 10 to rotate the shift-back lever 182 and the paper feed gear lever 187 so that the arm 187*a* is disengaged from the hook 189*a* of the paper feed clutch gear 189.

Since the paper feed clutch lever 189 normally presses the back of the hook 189*a* by the bent portion 190*b* of the leaf spring 190, it slides in the direction of the arrow d after it has been disengaged from the arm 187*a* of the paper feed gear lever 187 and meshes with the worm shaft 106 and rotates in the direction of the arrow d.

After the paper feed clutch gear 189 has started to rotate, the paper feed solenoid 177 is deenergized and the paper feed gear lever 187 has its arm 187*a* returned toward the paper feed clutch gear 189 by a spring, not shown, and after one revolution it again engages with the hook 189*a* to stop the rotation thereof. Since the portion of the paper feed clutch gear 189 which meshes with the worm shaft 106 has no tooth at this time, the rotation is not transmitted.

The operation of the paper feed clutch gear 189 has thus been described. The operation of the shift-back clutch gear 186 is exactly same.

The solenoid 177 is energized to rotate the paper feed clutch gear 189 in order to feed the paper after the desired character has been printed. When the print mode is switched from the symbol print mode to the numeral print mode, it is necessary to feed the paper by the interval between the symbol printing type belt 119 and the black numeral printing type belt 120 so that the symbol and the numeral are aligned on the same line. In this case, simultaneously with the completion of the symbol printing, the hook 115*e* of the carriage 115 is hooked to the arm 187*b* of the paper feed gear lever 187 to move it so that the arm 187*a* is disengaged and the paper feed clutch gear 189 is rotated to feed the paper.

By rotating the paper feed clutch gear 189 in those two manners, the paper feed rack plate 191 and the rack 192 integral therewith are moved by the excentric cam 189*a*.

Figure 14:
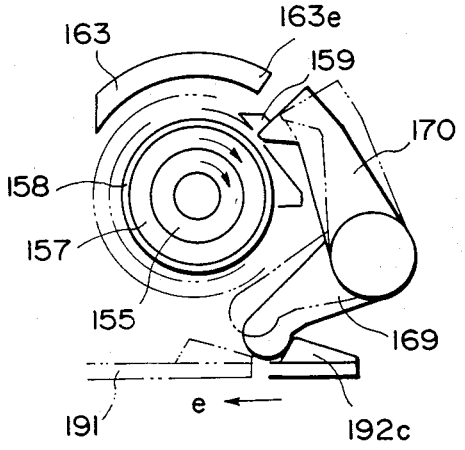

Referring to FIG. 14, when the rack plate 191 is moved in the direction of the arrow e, the paper feed gear 157 which meshes with the rack teeth 192*a* of FIG. 12B is rotated forwardly. At the same time, the arm 169*a* of the forward feed cam lever 169 is lifted up by the cam 192*c* so that the forward feed cam lever 169 and the forward feed lever 170 which is moved therewith through the spring 171 are moved together to disengage from the pawl 159*a* of the ratchet 159. As a result, the rotation of the paper feed gear 157 is transmitted to the ratchet 159 and the boss 155 through the squeezed clutch spring 158 and they are rotated together.

However, since the engagement of the cam 192*c* is weak, the arm 169*a* of the forward feed cam lever 169 descends and the arm 170*b* of the forward feed cam lever 170 is returned to the original position and it meshes with the next pawl to the pawl 159*a* of the ratchet 159. As a result, the rotation of the ratchet 159 is stopped and the rotation of the paper feed gear 157 is not transmitted to the boss 155.

At this time, the arm 165*a* of the reverse feed cam lever 165 is also lifted up but it does not move because the projection 166*b* thereof contacts to the cam 163*f* of the control cam 163. As a result, the arm 166*a* of the reverse feed lever 166 remains engaged with the pawl 161*a* of the ratchet 161 and the ratchet 161 does not rotate.

Figure 15:
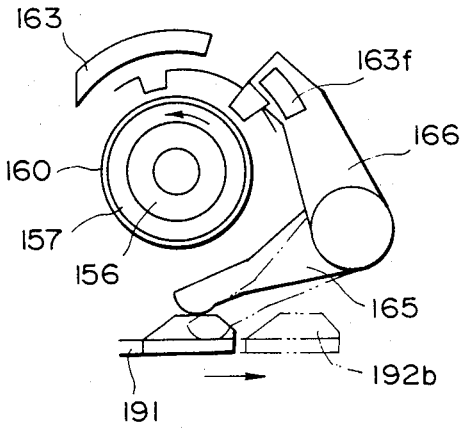

When the rack plate 191 is moved oppositely to the arrow e shown in FIG. 15, the paper feed gear 157 is also rotated oppositely. Since the projection 166*b* of the reverse feed lever 166 contacts with the control cam 163*f* as described above, the ratchet 161 does not rotate and the rotation of the paper feed gear 157 is not transmitted to the boss 156. In this manner, in the forward paper feeding, the rubber roll shaft 151 is rotated by one pawl pitch of the ratchet 159 or $\frac{1}{8}$ revolution per movement of the rack plate 191 and the rack 192, that is, per revolution of the paper feed clutch gear 189, and the rubber roll 152 secured thereto are rotated together to feed the print paper pinched by the pinch roll 153 forwardly by a predetermined amount.

The operation of the shift-back mechanism is now described.

After the desired character has been printed, the paper feed solenoid 177 shown in FIG. 10 is energized and the same operation as that in the paper feed operation described above is carried out until the shift-back clutch gear 186 is rotated. It is a tensional force of the spring 185 shown in FIG. 11 that restores the engagement of the arm 182*b* of the shift-back lever 182.

As the shift-back clutch gear 186 starts to rotate, it presses down the arm 111*h* of the hammer plate 111 which contacts to the cam 186*a* and rotates the hammer plate 111 counterclockwise as viewed in FIG. 12B around the shaft 112. As a result, the projection 115*h* of the carriage 115 is disengaged from the projection 111*g* of the hammer plate 111 and the carriage 115 is pulled by the spring 197 and returns to the home position prior to the printing. After the cam 186*a* has rotated by a predetermined angle, it returns the hammer plate 111 to the original position. In this manner, the shift-back operation is carried out.

Figure 16:
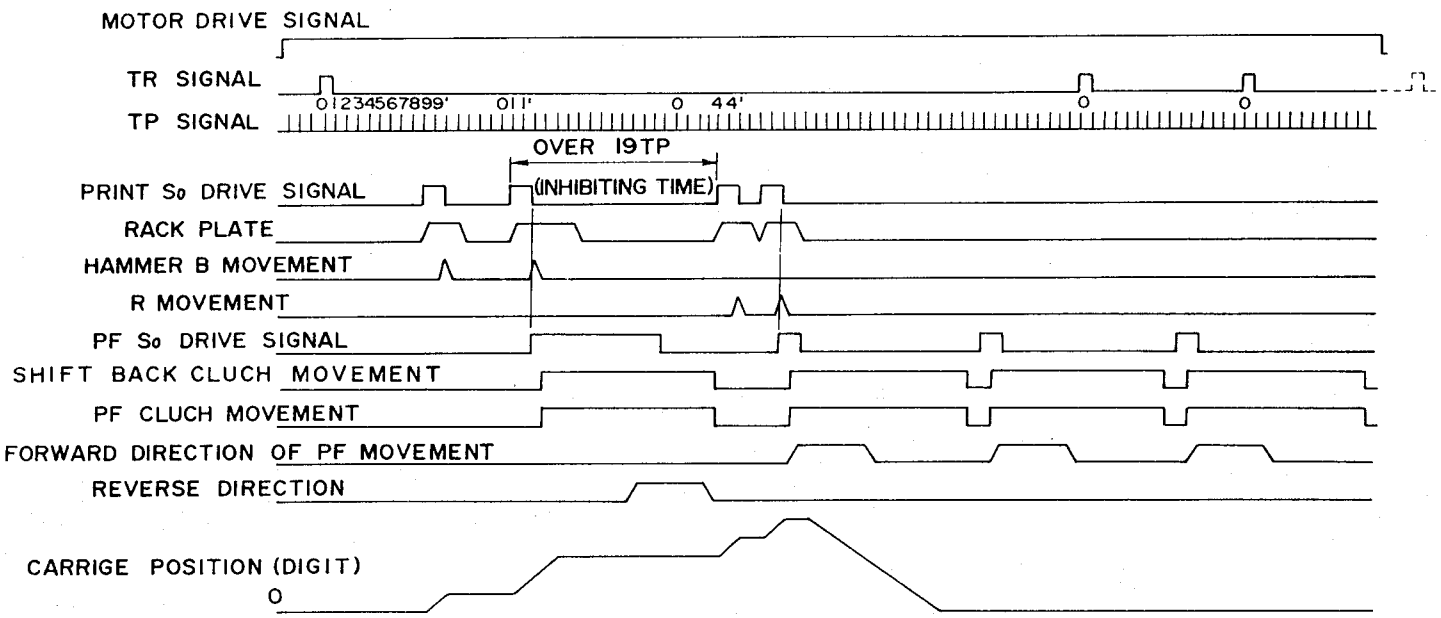

The red character printing operation is now explained with reference to a timing chart shown in FIG. 16.

The red character printing operation is substantially identical to the black character printing operation described above except the operation of the carriage 115 and the operation of the paper return mechanism.

The operation of the carriage is as follows.

The symbol digit printing operation is same as that in the black character printing, but after the symbol digit has been printed, the paper feed solenoid 177 is energized to feed the paper and shift back the carriage as described above. However, since the hammer plate 111 has fallen down at this time by the shift-back operation, the shifting projection 143*a* of the hammer shift lever 143 shown in FIG. 12A cannot ride over the cam 111*e* so that the shift lever 143 and the hammer levers 135 and 139 are at the same level as in the symbol printing operation. At this time, since the arm 139*a* of the red character printing hammer lever 139 is positioned to engage with the red character printing projection 111*d* and the arm 135*b* of the hammer lever 135 is between the black character printing projection 111*c* and the red character printing projection 111*d*, the block character printing hammer lever is not activated even if the carriage 115 is moved.

On the other hand, when the carriage 115 is moved, it pushes up the switch pin 163*a* by the switch cam 115*d* so that the control cam 163 is rotated around the rubber roll shaft 151. As the paper feed solenoid 177 is energized, the stop member 179*b* of the pivotal lever 179 is slid to engage with the stop member 163*b* of the control cam 163 to prevent the return of the control cam 163. As the control cam 163 is rotated, the stop color 195 which has been engaged with the stopper 163*d* and pushed up is moved upward and abuts against the carriage 115. When the rack plate 115 is fallen down, the stop projection 111*g* is disengaged from the projection 115*h* but the carriage 115 is not returned because it is held by the stop color 195.

The paper feed operation is now explained.

After the symbol digit has been printed, the paper feed solenoid 177 is energized to feed the paper. The print paper must be fed reversely by a distance equal to the spacing between the black character printing type belt 119 and the red character printing type belt 121 so that the symbol print and the red character print are aligned on the same line.

Figure 17:
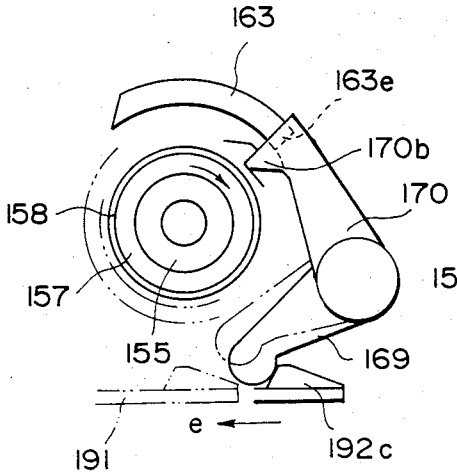
Figure 18:
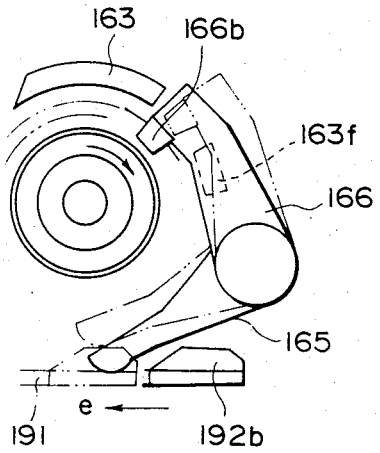

In this case, as shown in FIGS. 17 and 18, the control cam 163 is rotated forwardly so that the projection 170*b* of the forward feed lever 170 contacts to the cam 163*e* and the arm 169*a* of the cam lever 169 is pushed upward as the paper feed rack 192 is moved in the direction of the arrow e to disengage the projection 166*b* of the reverse feed lever 166 from the cam 163*f*, but the engagement is not released as described above and the paper feed ratchet 159 does not rotate. Similarly, the arm 165*a* of the reverse feed cam lever 165 is lifted up and disengaged from the paper feed ratchet 161.

Figure 19:
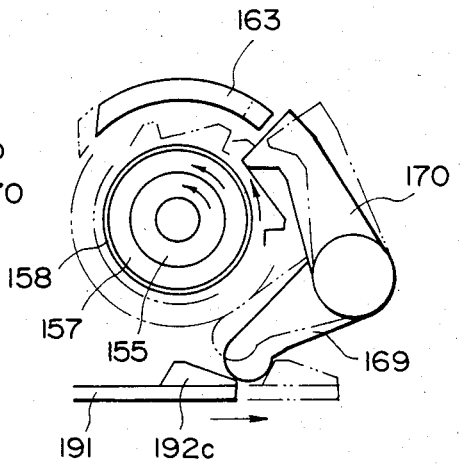
Figure 20:
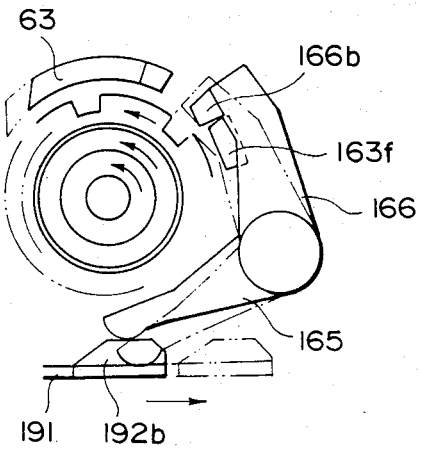

When the paper feed rack 192 has been moved to a maximum extent, that is, when the clutch gear has been rotated by 180 degrees, the paper feed solenoid 177 is deenergized. Thus, in FIGS. 19 and 20, the engagement of the stop member 163*b* of the control cam 163 is released and the control cam 163 tends to return to the original position. However, since the projection 166*b* of the reverse feed lever 166 is in the lifted position, the cam 163*f* abuts against it and the control cam 163 cannot return.

Under this condition, when the rack plate 192 starts to return opposite to the arrow e, the rotation of the paper feed gear 157 is transmitted to the paper feed ratchet 161 and the boss 156 which have been disengaged by the clutch spring 160 and they start to rotate together. Since the boss 155 is also rotated together at this time, the ratchet 159 is also rotated through the clutch spring 158. As the arm 165*a* of the reverse feed cam lever 165 starts to descend, the engagement is restored and the rotation is no longer transmitted. In this manner, in the reverse paper feed operation, the rubber roll shaft 151 and the rubber roll 152 are rotated by one pawl pitch of the ratchet wheel or 1/6 revolution per movement of the paper feed rack 192, that is, per revolution of the paper feed clutch gear 189 so that the print paper P is fed reversely.

After the desired red character printing has been completed, it is necessary to move the paper feed ratchet 161 reversely by one pawl pitch and the ratchet 159 forwardly by two pawl pitches. By energizing the paper feed solenoid 177, the paper is fed three times as is done in the black character printing.

As seen from the above, the present embodiment offers the following excellent advantages.

(1) Since the printing and the shifting are simultaneously carried out, a high speed printing is attained.

(2) Since the type is pressed to the print paper while it is rolling, a print noise is reduced.

(3) Since the type selection, the printing and the shifting are carried out by controlling the drum gear fixed to the rotating type drum, no special clutch is needed for the drive mechanism of the type drum and the construction is simplified.

(4) The ink rolls of different colors and the corresponding type belts are provided to enable two-color printing, and the symbol, black character and red character type belts are separated in the direction of paper feed and the two color ink rolls are prevented from contacting to the type belts when the ink rolls are mounted or removed. Accordingly, the inks of different colors are not mixed.

In the above embodiment, the type drum 117 is arranged with the axial line thereof being orthogonal to the print direction and the black character printing type belts 120 and 119 and the red character printing type belt 121 are arranged to be vertically separated and the print paper P is shifted forwardly or reversely to print the characters on the same print line. Accordingly, the mixing of colors due to overprinting of different color inks on the print paper does not occur.

Figure 21:
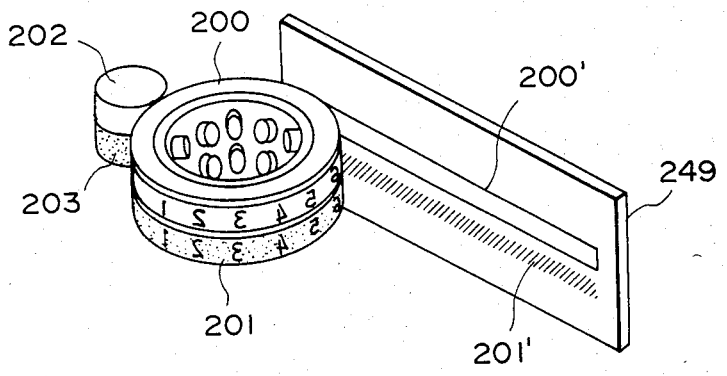
FIGS. 21–24 show embodiments of a type drum.

The mechanism for preventing the mixing of colors is not limited to that shown in the above embodiment. For example, as shown in FIG. 21, a black character printing type belt 200 and a red character printing type belt 201 may be provided and ink rolls 202 and 203 of the respective colors may be provided. In this construction, since black print 200' and red print 201' are vertically separated, the inks are not mixed. In order to print the characters on the same print line, the print paper is shifted forwardly or reversely as is done in the previous embodiment.

Figure 22:
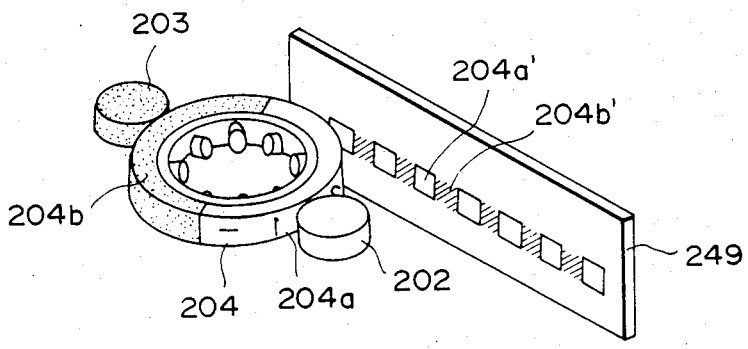
Figure 23:
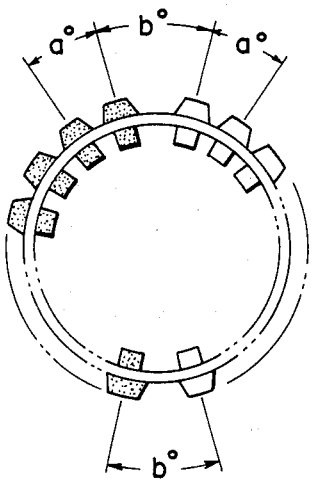

FIGS. 22 and 23 show a still further embodiment of the present invention. In the present embodiment, a type belt 204 is split to a black character printing half 204a and a red character printing half 204b, and a black ink roll 202 and a red ink roll 203 are arranged on left side and right side, respectively. The ink rolls 202 and 203 are controlled to contact to only the corresponding one of the different color halves 204a and 204b.

Types on the black character printing half 204a and the red character printing half 204b are spaced by a degrees, and the types on the black character printing half 204a and the types on the red character printing half 204b are spaced by $b° = a° \pm \frac{1}{2}a°$. That is, the types of the black character printing half 204a are offset by ½ pitch. Accordingly, print positions 204a' and 204b' on a platen 249 are alternately offset and hence the inks are not mixed.

Figure 24:
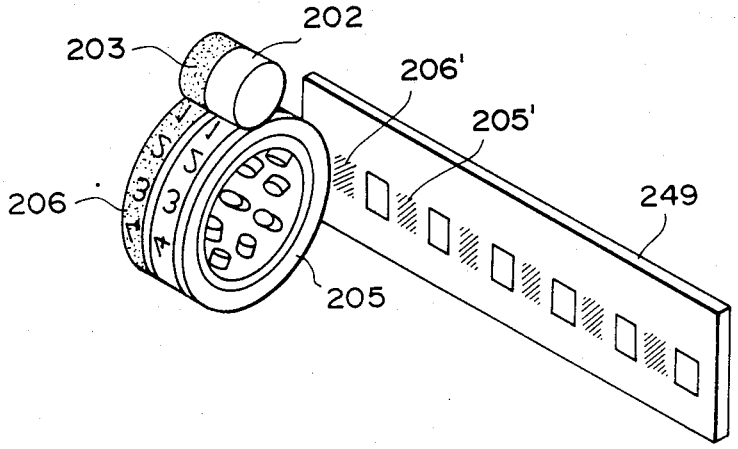

FIG. 24 shows a still further embodiment of the present invention. In the present embodiment, a black character printing type belt 105 and a red character printing type belt 106 are arranged along the print direction and corresponding ink rolls 202 and 203 are provided. In this construction, by shifting a carriage at a double pitch of a type drum pitch, different color prints 205' and 206' are alternately made and the inks are not mixed.

As seen from the above, according to the present embodiment, since the print positions of the different color type belts are separated in the paper feed direction or the print direction, the mixing of the different color inks on the same print line does not occur.

Figure 25:
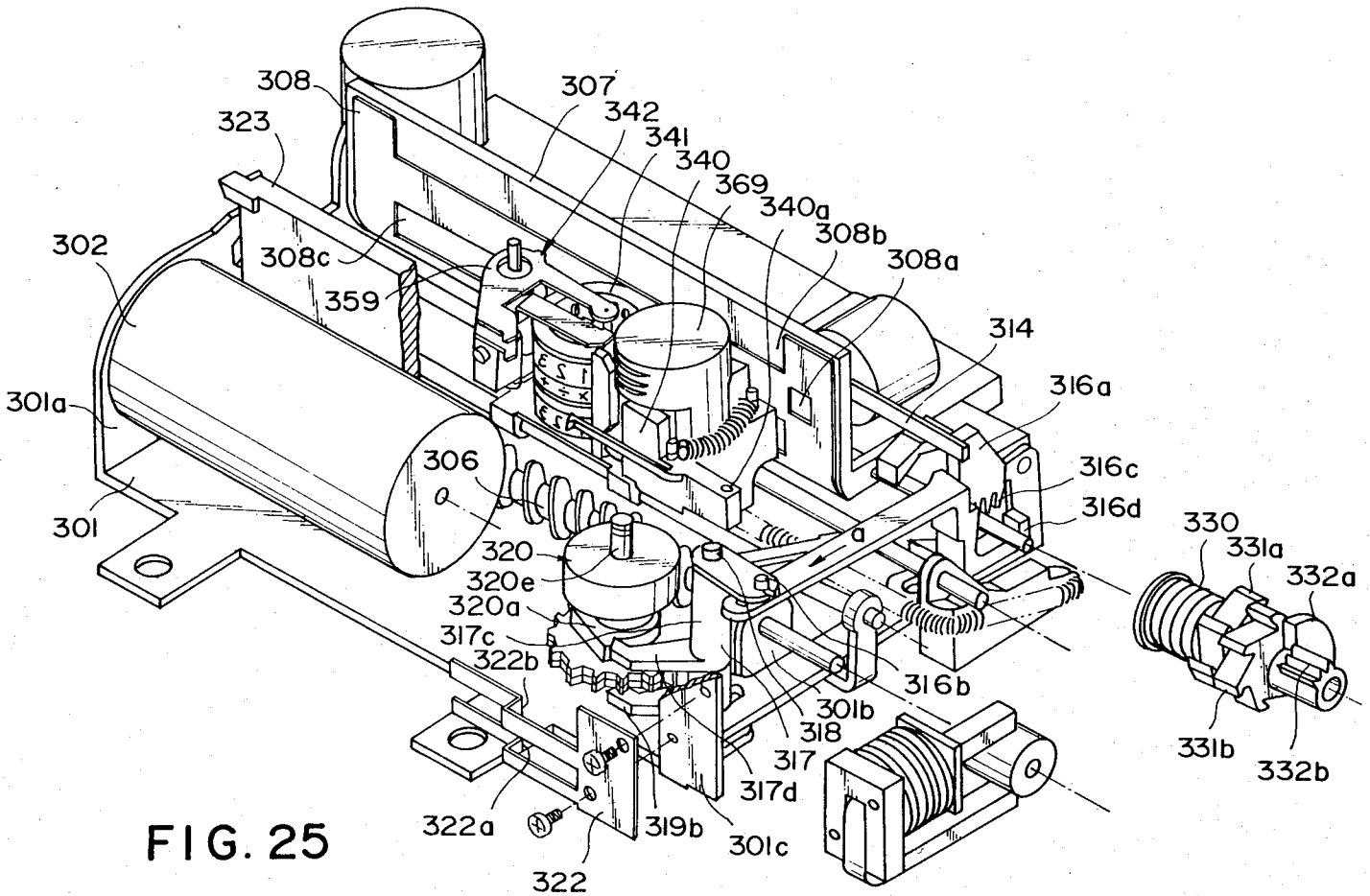
Figure 26:
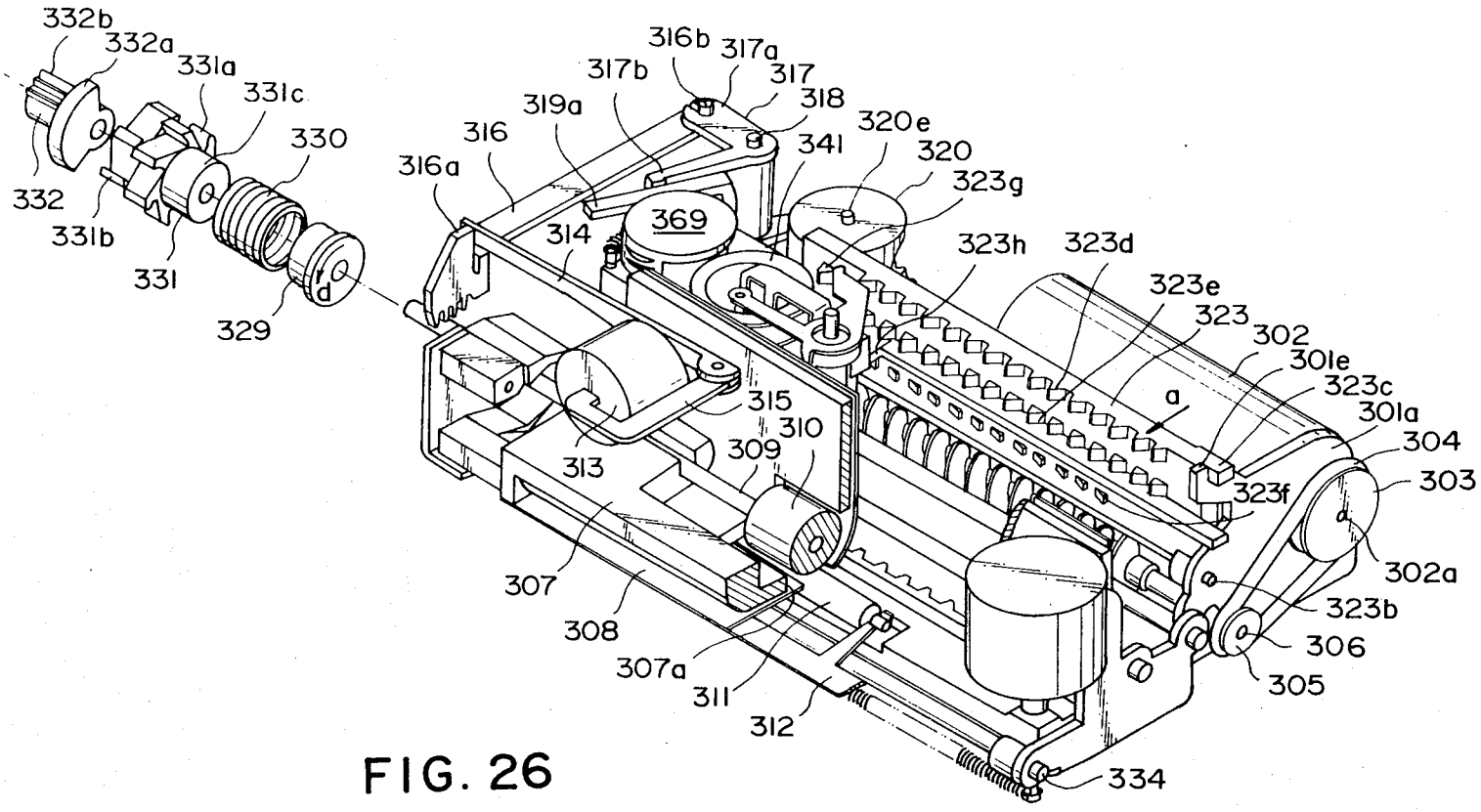

FIGS. 25–30 show a still further embodiment of the present invention, in which a paper feed mechanism is simplified. A motor 302 is mounted on a side plate 301aof a base 301. As shown in FIG. 26, a pulley 303 is fixed to an output shaft 302a of the motor 302. A worm shaft 306 is rotatably supported between the side plates 301a and 301b in parallel to an axial line of the motor 302. A plate 305 is fixed to one end of the worm shaft 306 on an outer side of the side plate 301a, and a belt 304 is spanned between the pulleys 305 and 303 to transmit the rotation.

A platen 307 is arranged on the opposite side of the base 301 to the motor 302 and a paper guide 308 is arranged inwardly thereof in a spaced relation therefrom. A print paper is guided therebetween. As shown in FIG. 25, the paper guide 308 has a symbol printing opening 308a and a black character printing opening 308b, and a red character printing elongated opening 308c is horizontally formed below the opening 308b.

A shaft 309 is rotatably supported on the outer side of the platen 307 in parallel thereto. A paper feed rubber roll 310 is fixed to the shaft 309. The rubber roll 310 is exposed to the paper guide 308 through an opening 307a formed in a bottom plate having an L-shaped section of the platen 307 and it pinches the print paper with an underlying pinch roll 311 to feed the print paper. The pinch roll 311 is urged toward the rubber roll 310 by a leaf spring 312.

A paper feed solenoid 313 is mounted on the outer side of the platen 307, and one end of a movable armature 314 is rotatably supported at one end of a yoke 315 of the solenoid 313. A free end of the movable armature 314 engages with a projection 316a formed at one end of a connecting lever 316 positioned on the side of the base 301. The other end of the connecting lever 316 is pivotably coupled to one arm 317a of a shift-back lever 317 through a pin 316b. The shift-back lever 317 is of generally V-shape and a center thereof is pivotably supported by a shaft 318. The other arm 317b of the shift-back lever 317 abuts against an arm 319a of a paper feed clutch lever 319 positioned on the side of the shift-back lever 317.

As shown in FIG. 26, the shift-back lever 317 has a shaft 317c which is fitted to the shaft 318 and another arm 317d at a lower end of the shaft 317c. The arm 317d engages with a pawl 320a of the paper feed clutch 320. The shift-back lever 317 is imparted with a force to pull the connecting lever 316 in the direction of an arrow a by a spring, not shown. A rack 316c is formed at a lower end of the projection 316a of the connecting lever 316, and a bent portion 316d is formed below the rack 316c and it extends to surround the rubber roll shaft 309. The paper feed clutch lever 319 is supported by the shaft 318 coaxially with the shift-back lever 317, and one end 319a thereof is positioned to engage with the arm 317b of the shift-back clutch lever 317 as shown in FIG. 26 and the other end has an arm 319b which engages with the pawl 321a of the paper feed clutch gear 321 of the shift-back clutch 320 as shown in FIG. 25. As shown in FIG. 27 by an enlarged view, the shift-back clutch 320 has an upper shift-back clutch gear 320b, a pawl 320a formed thereon, and a disc 320d which is integral with the clutch gear 320b and has a cam 320c a lower surface. The shift-back clutch gear 320b is rotatably supported by a shaft 320e which extends from the base 301. The paper feed clutch gear 321 is rotatably supported by the shaft 320e below the shift-back clutch gear 320b. A pawl 321a is integrally formed on the lower surface of the paper feed clutch gear 321 and an eccentric cam 321b is integrally formed on the lower side thereof.

A leaf spring 322 is mounted on a side plate 301c which extends from the base 301 on the side of the shift-back clutch gear 320b and the paper feed clutch gear 321. The leaf spring 322 has two arms 322a and 322b which extend toward the clutch gear. The upper arm 322b engages with the pawl 320a and the lower arm 322a engages with the pawl 321a. Since the arm 319b of the shift-back lever 319 engages with the pawl 321a, the paper feed clutch gear 321 does not rotate althrough the pawl 321a is pressed by the arms 322b and 322a of the leaf spring 322. The shift-back clutch gear 320b and the paper feed clutch gear 321 are positioned to mesh with the worm shaft 306, but since two teeth thereof are removed, the rotational force is not transmitted when the worm shaft 306 faces to the non-toothed area.

Numeral 323 denotes a hammer plate. A projection 323a is formed on an outer side at one end of the hammer plate 323 and it engages with a cam 320c formed on the lower side of the disc 320a. The hammer plate 323 is rotatably supported on the substrate 301 by a shaft 323b and normally biased toward a type drum 322a by a spring, not shown. When a projection 323c formed at one end of the hammer plate 323 engages with the projection 301e of the side plate 301a, the pivotal movement of the hammer plate 323 is restricted. Numeral 324 in FIG. 27A denotes a paper feed sliding plate which is of generally L-shape. An oval opening 324a to which the eccentric cam 321b is fitted is formed in a bent portion at one end of the sliding plate 324, and slots 324b and 324c for guiding linear movement of the sliding plate 324 are formed in a straight portion of the sliding plate 324. The shaft 318 is fitted to the slot 324b and a guide pin 380 extending from the substrate 301 is fitted to the slot 324c. A rising portion 324d is formed at the opposite end of the sliding plate 324 to the opening 324a and shafts 325 and 326 project horizontally from the side of the sliding plate 324. A pawl lever 327 is rotatably supported by a shaft 325 and a pawl lever 328 is rotatably supported by a shaft 326. The pawl levers 327 and 328 are biased by springs, not shown, so that their free ends approach to each other. When projections 327a and 328a of the pawl levers 327 and 328 engage with projections 324e and 324f formed on the rising portion 324d, the pivotal movement is restricted.

A boss 329 is fixedly fitted to the rubber roll shaft 309. A clutch spring 330 is wrapped around the boss 329. A ratchet wheel 331 is rotatably supported by a shaft 309 to oppose to the boss 329. The ratchet wheel 331 has a boss 331c on which the clutch spring is wrapped, a ratchet 331a which engages with the pawl 327c of the pawl lever 327 and a ratchet 331b which engages with the pawl 328c of the pawl lever 328.

Numeral 332 denotes a switch cam which is fixedly fitted to the shaft 309. The cam 332 has a cam portion 332a which contacts to the pawls 327b and 328b of the pawl levers 327 and 328, and a gear portion 332b which meshes with the rack 316c of the connecting lever 316.

Numeral 333 denotes a stop lever which has a projection 333a which engages with a cam 324g of the paper feed sliding plate 324 and a projection 333b which engages with the ratchet wheel 331. It is rotatably supported by a shaft 334 of a rack plate 334a which is rotatably supported by the shaft 334 under the platen 307, and biased by a spring, not shown, in the direction to mesh with the ratchet wheel 331.

Figure 27A:
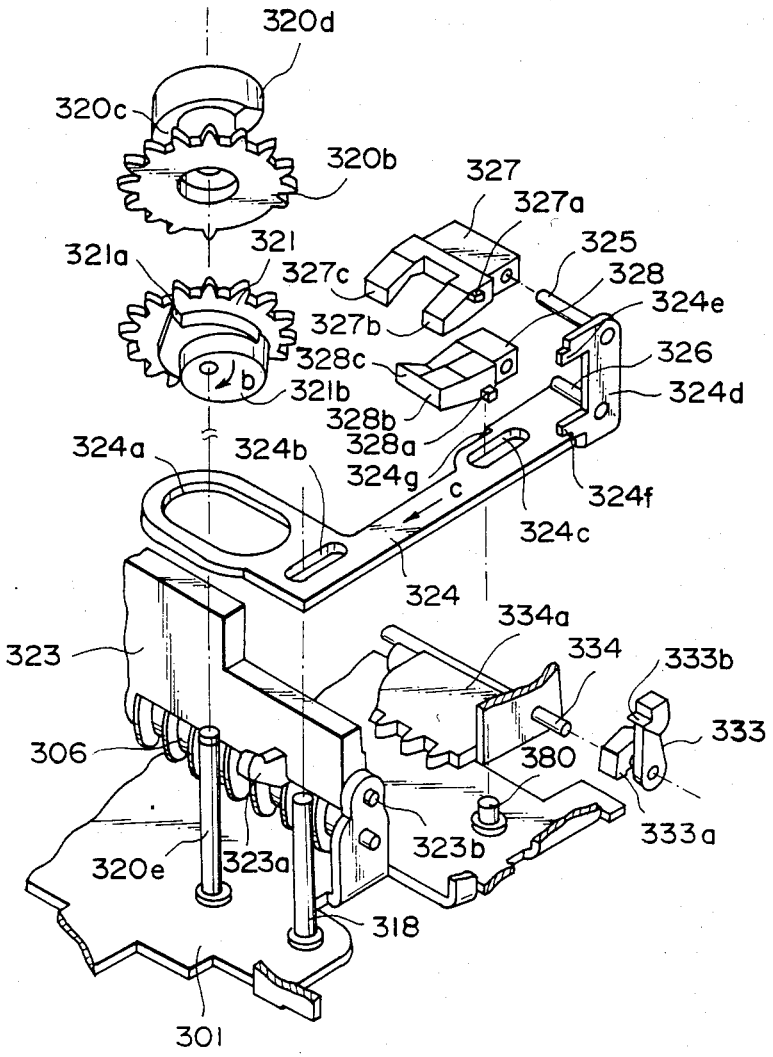
FIGS. 27A and 27B show developed perspective view of a paper feed unit and a carriage.
Figure 27B:
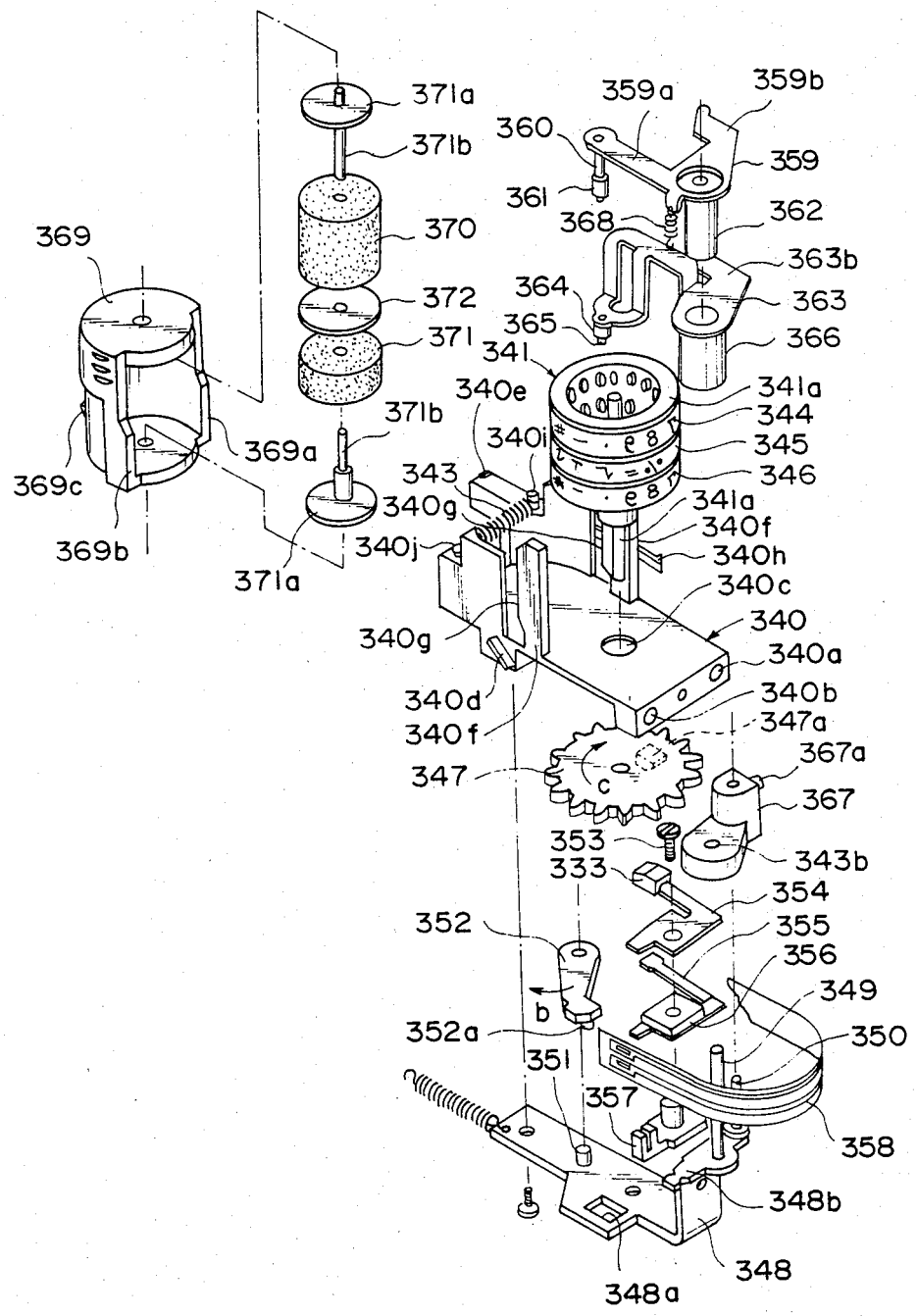

A carriage 340, a type drum 341 and a hammer 342 are constructed as shown in FIG. 27B. The carriage 340 has apertures 340a and 340b at a bottom thereof, to which a guide bar for guiding the carriage are fitted and an aperture 340c at a center thereof, to which a shaft 341a at the lower end of the type drum 341 is formed.

A cam 340d for switching the control cam which controls the print paper feed obliquely extends from one side of the carriage 340, and a projection 340e for actuating a paper feed clutch to be described later is formed at a projection projecting from one end of the carriage 340.

Guide plates 340f extend upwardly from the opposite sides of the carriage 340, and a cam 340g is formed on the side thereof facing toward the cam 340d.

Pins 340i and 340j project from the carriage 340 and a spring 343 for supporting an ink roll case is spanned therebetween.

The type drum 341 has a cylindrical base 341a and has its axial line arranged to be orthogonal to the print direction. A black character printing type belt 344 is mounted on an outer periphery of the type drum 341, a black printing symbol type belt 345 is mounted at a center portion thereof, and a red character printing type belt 346 is mounted by a resilient member.

A carrier stop pawl 340h which engages with the projection 311 of the hammer plate 323 is formed on the opposite side edge of the carriage 340 to the cam 340d.

A shaft 341a projecting from the lower end of the cylindrical base 341a of the type drum 341 extends through the aperture 340c of the carriage and is fixed to a drum gear 347 positioned under the carriage 340. The drum gear 347 has as many teeth as the number of types of the type belt mounted on the type drum 341, and a projection 347a which is used to generate a reset signal to detect an initial position of the type is formed on the lower surface of the drum gear 347.

Numeral 348 in FIG. 27B denotes a carrier which is fixed to the lower side of the carriage 340. The carrier 348 is integral with the carriage 340. The carrier 348 has a hammer shaft 349, a guide shift 350 for the hammer shift, and a shaft 351 which supports a rack plate control lever each extending vertically. Numeral 352 denotes the rack plate control lever having one end thereof rotatably supported by the shaft 351. It is normally imparted with a rotational force clockwise as viewed in FIG. 27B or in the direction of an arrow b by a spring, not shown. A positioning pin 352a projects from a lower surface at a free end of the rack plate control lever 352 and it is fitted to an opening 348a formed in the carrier 348 so that the pivotal movement thereof is restricted within the opening 348a.

A movable contact 354 and a stationary contact 355 are mounted on the carrier 348 by a screw 353. They are fixed to a mount 357 by the screw 353 with an insulating plate 356 being interleaved therebetween. A contact cam 354 is fixed to an end of the movable contact 354 and it contacts to the projection 347a of the drum gear 347 and urged toward the stationary contact 355 to establish an electrical conduction therebetween. The contact of the stationary contact 355 and the movable contact 354 occurs once in one revolution of the drum gear 347.

Numeral 355 denotes a flexible printed circuit board having one end thereof connected to terminals of the movable contact 354 and the stationary contact 355 and the other end thereof connected to terminals, not shown, on the base.

Numeral 359 denotes a black character printing hammer which is of generally L-shape. A hammer roll 361 is rotatably supported by one arm 359a of the hammer 359 through a roll shaft 360 and the other arm 359b thereof is positioned to contact to print projections 323d and 323e of the hammer plate 323. A cylindrical bearing 362 is fixed to a base of the black character printing hammer 359. The bearing 362 is rotatably and slidably fitted to the hammer shaft 349. A red character printing hammer 363 is mounted coaxially with the black character printing hammer 359. The red character printing hammer 363 is constructed in substantially same manner as the black character printing hammer 359 and a hammer roll 364 is rotatably fitted to a roll shaft 365 at an end of one arm of the hammer 363 and the other arm 363a thereof is positioned to engage with the projection 323g of the hammer plate 323. A cylindrical bearing 366 is fixed to a base of the red character printing hammer 363, and the bearing 362 of the black character printing hammer 359 is rotatably fitted to the cylindrical bearing 366.

A hammer shift lever 367 is rotatably fitted to the hammer shift lever shaft 350. One end of the hammer shift lever 367 projects toward the shaft 349 and the shaft 349 is fitted into the aperture 367b formed in the hammer shift lever 367. Accordingly, the hammer shift lever 367 cannot rotate but is axially slidable. A shifting projection 367a is formed on an outer side of a base of the hammer shift lever 367 and it engages with a cam 323h formed on the hammer plate 323 and slides over the cam 323h so that the black character printing hammer 359 and the red character printing hammer 363 are shifted up. Lower ends of the bearings 362 and 366 of the black character printing hammer 359 and the red character printing hammer 363 are mounted on the projection of the hammer shift lever 367 closer to the aperture 367b.

A return spring 365 for returning the carriage by a shifted amount is spanned between the base of the black character printing hammer 359 and a spring hook 348b formed at one end of the carrier 348 so that the black character printing hammer 359 is normally biased downwardly.

An ink roll case 369 is detachably fitted to a space between the spring 343 of the carriage 340 and a pair of guide frames 340f. The ink roll case 369 is opened on a side facing to the type drum 341, and cams 369a and 369b which are complementary to the cams 340g of the guide frames 340f are formed on the open side. A recess 369c is formed on an outer side of the ink roll case 369 orthogonally to an axial line of the ink roll case 369, and the spring 343 fixed to the carriage 340 is fitted thereto.

The ink roll case 369 contains a black ink roll 370 and a red ink roll 371. Shafts 371b having flanges 371a are arranged axially in the ink roll case 369 and the black and red ink rolls 370 and 371 are rotatably supported by the shafts 371b with a spacer 372 being interleaved therebetween. The shafts 371 are constructed to permit mutual fitting so that the ink rolls 370 and 371 can be readily removed. The ink roll case 369 which contains the ink rolls 370 and 371 is mounted on the carriage 340. When it is mounted or removed, the ink rolls 370 and 371 do not contact to the type belts 344–346 of the type drum 341 except when it is completely mounted because the cams 369a and 369b and the cams 340g of the guide frames 340f are complementary to each other, and the ink rolls contact to the type drum only when the complementary cams perfectly engage. Under this condition, since the spring 343 is fitted to the recess 369c of the ink roll case 369, the ink rolls 370 and 371 are urged to the type drum 341 and the axial movement thereof is restricted so that they are positively mounted. Accordingly, when the ink roll case 369 is mounted or removed, the black and red printing ink rolls 370 and 371 do not contact to the type belts 344–346 and the inks are not mixed.

The operation of the present embodiment thus constructed is now explained.

When the motor 302 is energized upon a print instruction, the rotation thereof is transmitted to the output shaft 302a, the pulley 303, the belt 304 and the pulley 305 so that the worm shaft 306 to which the pulley 305 is fixed starts to rotate.

As the worm shaft 306 rotates, the drum gear which is integral with the type drum 341 mounted on the carriage 340 meshed with the worm shaft 306 is rotated and the type drum 341 starts to rotate. When a type to be printed of one of the type belts mounted on the type drum 341 reaches a print position, the print hammer 342 is rotated by the projection 323d or 323e formed on the surface of the hammer plate 323 and the type belt is projected to print the character.

After the desired character has been printed, the paper feed solenoid 313 is energized and the movable armature 314 is attracted so that the connecting lever 316 is pulled forwardly as viewed in FIG. 26 and the shift-back lever 317 is rotated counterclockwise as viewed in FIG. 26 around the shaft 318. The arm 319a is urged by the arm 317b counterclockwise to rotate the paper feed clutch lever 319 counterclockwise as viewed in FIG. 26 to disengage the arm 319b from the pawl 321a of the paper feed clutch gear 321.

Since the paper feed clutch gear 321 has a rear surface of its pawl 321a normally pressed by the arm 322a of the leaf spring 322, it is rotated in the direction of the arrow b in FIG. 27 when it is disengaged from the arm 319b of the paper feed clutch lever 319. Since the non-toothed area of the paper feed clutch gear 321 moves away from the worm shaft 306, the paper feed clutch gear 321 starts to mesh with the worm shaft 306 and the paper feed clutch gear 321 continues to rotate in the direction of the arrow b.

After the paper feed clutch gear 321 has started to rotate, the paper feed solenoid 313 is deenergized and the paper feed clutch lever 319 has its arm 319b normally pulled toward 321a by a return spring, not shown. Accordingly, as the paper feed clutch gear 321 is rotated one revolution, the arm 319b again engages with the pawl 321a and stops the rotation.

At this time, the portion of the paper feed clutch gear 321 which meshes with the worm shaft 306 is the non-toothed area and hence the rotation is not transmitted.

The operation of the paper feed clutch gear 321 has thus been described. The operation of the shift-back clutch gear 320b is exactly same.

The solenoid 313 is energized to rotate the paper feed clutch gear 321 in the paper feed operation after the desired character has been printed. This operation is also carried out when the print mode is switched from the symbol print mode to the numeral print mode.

In this case, simultaneously with the completion of the symbol printing, the hook 340a of the carriage 340 is hooked to the arm 319a of the paper feed clutch lever 319 to disengage the arm 319b from the pawl 321a of the paper feed clutch gear 321 and rotate the paper feed clutch gear 321 to feed the paper.

The operations of the above two cases, that is, the operation after the printing of the desired character and the operation of switching from the symbol printing to the numeral printing are explained in detail.

As the paper feed clutch gear 321 is rotated, the eccentric cam 321b is rotated and the sliding plate 324a which engages with the eccentric cam 321b through the opening 324a is moved in the direction of the arrow c in FIG. 27 and the pawl levers 327 and 328 are also moved. When the paper feed slide plate 324 starts to move in the direction of the arrow c, the solenoid 313 is deenergized as described above. Accordingly, the connecting lever 316 is restored to the original position and the one end of the cam 332a of the switch cam 332 presses the pawl 327b of the pawl lever 327 as shown in FIG. 28 to prevent the engagement of the pawl 327c and the ratchet 331b.

Figure 28:
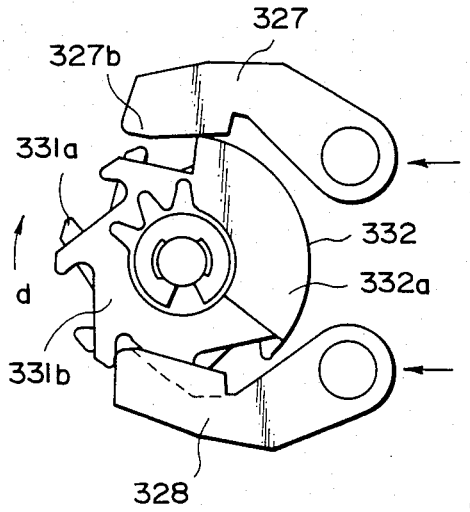

Accordingly, only the pawl 328b of the pawl lever 328 meshes with the ratchet 331b to rotate the ratchet wheel 331 by one tooth pitch in the forward direction of the paper feed, that is, in the direction of the arrow d in FIG. 28. This rotation causes the clutch spring 330 to be wound in and it is transmitted to the boss 329 so that the shaft 309 integral therewith and hence the rubber roll 310 are rotated to feed the paper forwardly.

Figure 29:
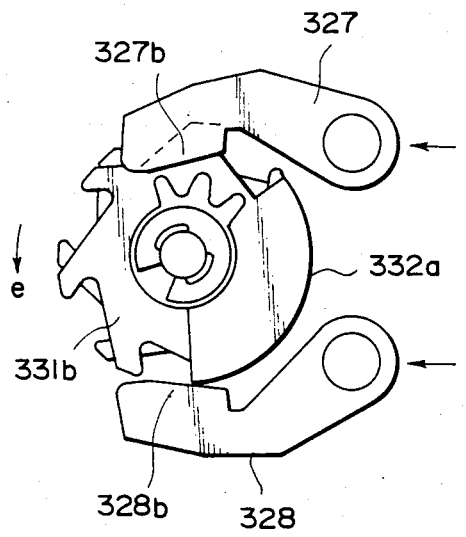

In the black character printing operation, the rubber roll 310 is rotated forwardly, that is, in the direction of the arrow d by a predetermined pitch by the ratchet 331b and the pawl lever 328e, as shown in FIG. 28. Then, as shown in FIG. 29, the cam 332a presses the pawl 328a downwardly so that the ratchet 331b is disengaged from the pawl lever 328 and the pawl lever 327 now engages with the ratchet 331a. Thus, the rubber roll 310 is rotated reversely, that is, in the direction of the arrow e and the print paper is returned to the original position so that the characters are printed on the same line. In the black character printing operation, the paper feed clutch gear 321 is rotated two revolutions in one print cycle to feed the paper with cooperation of the pawl levers 327 and 328 and the ratchets 331*a* and 331*b* as shown in FIGS. 28 and 29.

The red character printing operation is now explained.

After the symbol digit has been printed, the solenoid 313 is energized to feed the paper. The print paper should be fed reversely by a distance equal to the spacing between the symbol type belt and the red numeral type belt of the type drum 341 so that the symbol and the red numeral are printed on the same print line.

FIG. 29 illustrates the reverse paper feed operation.

The paper feed solenoid 313 is energized, the paper feed clutch gear 321 is rotated and the sliding plate 324 and the pawl lever 327 and 328 integral therewith are moved in the direction of the arrow c in FIG. 27, as is done in the black character printing operation. In the red character printing operation, however, the solenoid 313 is not immediately deenergized but kept energized while the sliding plate 324 moves in the direction of the arrow c.

As a result, the connecting lever 316 is kept pulled in the direction of the arrow in FIG. 25, and the switch cam 332 is kept rotated by the engagement of the rack 316*c* formed at one end of the connecting lever 316 and the gear 332*b* of the switch cam 332, and the connecting lever 316 maintains the condition shown in FIG. 29. Accordingly, as the pawl lever 328 is moved, the pawl lever 328 rides over the cam 332*a* as shown in FIG. 29 and the pawl lever 327 meshes with only the ratchet 331*a* to rotate the ratchet wheel 331 in the reverse direction or the direction of the arrow e. Since the pitch between the red character printing type belt and the symbol printing type belt is larger than the pitch between the black character printing type belt and the symbol printing type belt, the amount of reverse rotation is also larger.

The clutch spring 330 wound between the ratchet wheel 331 and the boss 329 is squeezed by the rotation in the direction of the arrow d in FIG. 28 to transmit the rotation, and loosed by the rotation in the direction of the arrow e. Since it is tightly inserted into the bosses, it transmits the rotation even in the reverse rotation if a load is small.

Accordingly, the reverse rotation is also transmitted to the rubber roll 310 through the shaft 309 to return the paper.

After the red character printing, it is necessary to feed the paper forwardly to a next print position. In this case, the print paper is fed three times forwardly by energizing the solenoid 313 in the same manner as in the black character printing operation. In the first paper feed, the paper is fed by a larger amount corresponding to the larger amount returned in the paper return operation described above.

In this manner, in the black character printing operation, the paper is fed forwardly two times, that is, by two pitches of the ratchet wheel, and in the red character printing operation, the paper is fed reversely by an amount larger than one pitch of the ratchet wheel and then forwardly by the same amount and by two pitches of the ratchet wheel so that the paper is fed forwardly three times in total.

Figure 30:
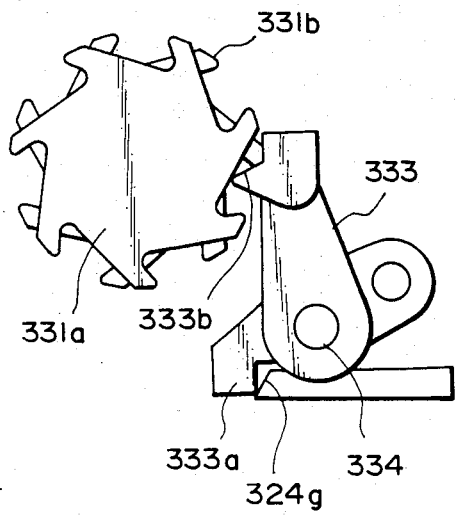

FIG. 30 illustrates the operation of the stop lever 333. The stop lever 333 normally meshes with the ratchet wheel 331. When the print paper is pulled out forwardly under this condition, the rubber roll 310, the rubber roll shaft 309 and the boss 329 which are integral are rotated, but the ratchet wheel 331 is not rotated because it is stopped by the stop lever 333 and merely idles through the clutch spring 330.

In the paper feed operation, the projection 333*a* of the stop lever 333 rides over the cam 324*g* of the sliding plate 324 so that the stop lever 333 is disengaged from the ratchet wheel 331 and the ratchet wheel 331 is rotated to rotate the rubber roll 310 through the clutch spring 330 to feed the paper.

As seen from the above, in accordance with the present embodiment, a pair of pawl levers for feeding the print paper by an appropriate amount either reversely or forwardly, the ratchet wheel rotated by those pawl lever and the switch cam for selecting one of the pawl levers are provided. Accordingly, a printer having a very simple paper feed mechanism can be provided.

Since the printing in different colors can be effected at different positions on the platen, the inks of different colors are not mixed even if the printing is effected without the print paper and hence the inks on the types and the ink rolls are also not mixed.

The ink rolls of different colors of the printer are rotatably supported within the ink roll case and they can be readily removed from the carriage together with the ink roll case when inks are to be supplemented.

However, since the shaft for rotatably supporting the ink roll and the shaft of the type drum are parallel, when the ink roll case which contains the ink rolls of different color is to be taken out of the carriage, the ink roll of one color contacts to the type belt of the other color when the ink roll case is moved because the ink rolls normally contact to the type belts, and hence the inks of different colors are mixed.

The present invention, resolves the above problem. In accordance with the present invention, when the ink roll case which contains the ink rolls is mounted or removed, the ink rolls do not contact to the type belts so that the inks of different colors are not mixed.

In order to achieve the above object, in accordance with the present invention, a cam is formed on the ink roll case which is removably mounted on the carriage, and a cam which complementarily engages with the cam of the ink roll case is formed on the carriage. A spring is mounted such that when the cams of the ink roll case and the carriage complementarily engage and the ink rolls of the different colors are set in positions to be urged to the type belts, the spring presses the ink roll case together with the ink rolls of different colors to the belts and prevents the ink roll case from coming out of the carriage.

Figure 31:
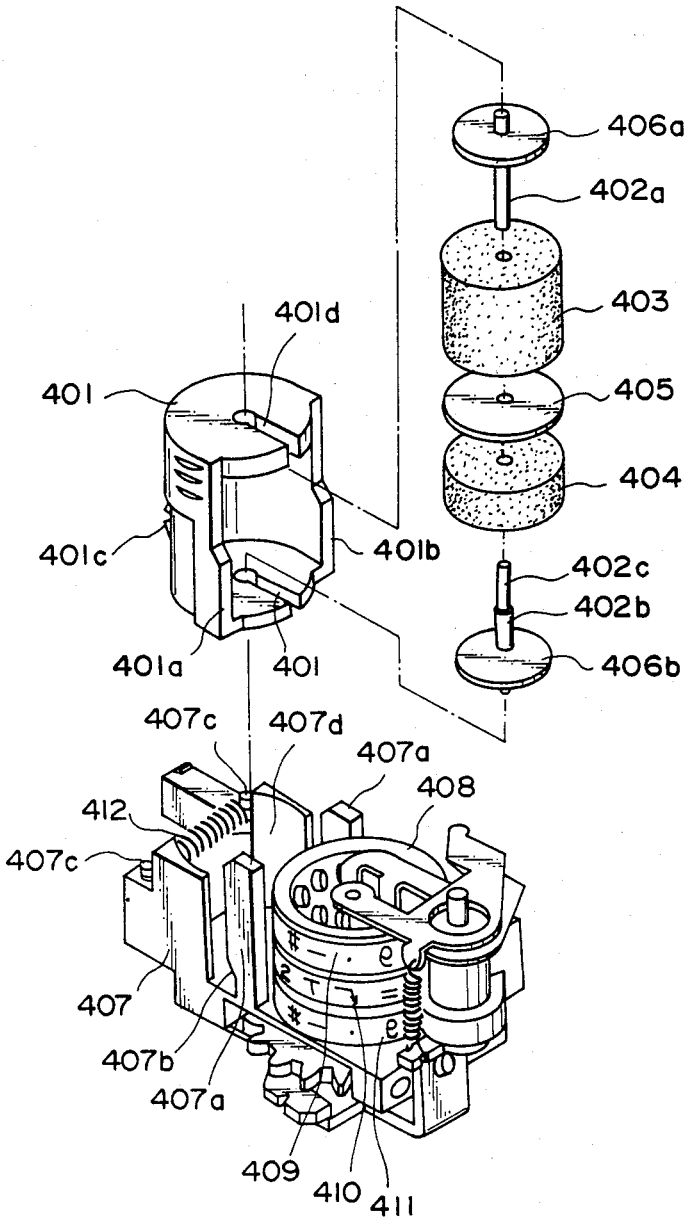
Figure 32:
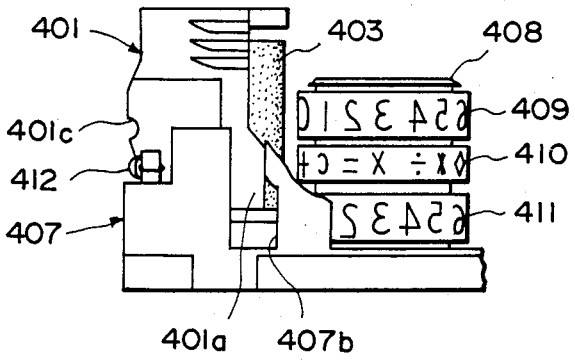
Figure 33:
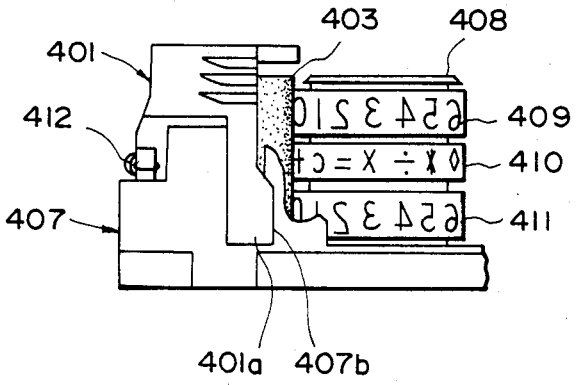

FIGS. 31–33 show one embodiment of the present invention, in which numeral 401 denotes an ink roll case of box shape having one side thereof opened and made of synthetic resin, for example. Cams 401*a* and 401*b* which project laterally symmetrically are formed on the open side edge of the ink roll case. Rotary shafts of ink rolls of different colors, to be described later, are fitted to upper and lower ends of the ink roll case 401, as viewed in FIG. 31, and elongated U-shaped slits 401*d* and 401*e* for rotatably supporting the rotary shafts are formed. Inner ends of the slots 401*d* and 401*e* are on the same axial line, and rotary shafts of the ink rolls of different colors are rotatably supported at the inner ends of the slits 401*d* and 401*e*.

A recess 401*c* to which a spring mounted on a carriage to be described later is fitted is formed on the opposite side of the ink roll case 401 to the open side, orthogonally to the axial line of the ink roll case 401. Shafts 402*a* and 402*b* which rotatably support the ink rolls are rotatably fitted to the inner ends of the slits 401*d* and 401*e* of the ink roll case 401. The shaft 402*a* is cylindrical and a reduced diameter portion of the other shaft 402*b* is fitted into the shaft 402*a* so that the shafts 402*a* and 402*b* are connected in union. Washers 406*a* and 406*b* are fixed to the ends of the shafts 402*a* and 402*b* and these portions are placed in the ink roll case 401 to prevent the drop of the ink rolls. A black ink roll 403 and a red ink roll 404 are rotatably supported by the integral shafts 402*a* and 402*b* with a spacer 405 being interleaved therebetween. They are spaced by the spacer 405 to prevent the mixing of the inks.

Numeral 407 denotes a carriage to which a type drum 408 is rotatably supported. A black numeral printing type belt 408, a black symbol printing type belt 410 and a red symbol printing type belt 411 are mounted on the type drum 408 in ring. The carriage 407 has a space 407*d* adjacent to the type drum 408, on which the ink roll case 401 is mounted. Guide frames 407*a* are integrally formed laterally symmetrically on both sides of the space 407*d* facing to the type drum 408. Cams 407*b* which are complementary to the cams 401*a* and 401*b* of the ink roll case 401 are formed on the bases of the guide frames 407*a*.

On the opposite side of the space 407*d* which accommodates the ink roll case 401, to the guide frames 407*a*, pins 407*c* are formed at opposing positions, and a spring 412 is spanned between the pins 407*c*.

The operation of the present embodiment thus constructed is now explained.

When the ink roll case 401 which contains the ink rolls 403 and 404 of different colors is mounted and removed, it follows a course shown in FIG. 32.

When the ink roll case 401 is to be mounted on the space 407*d* which accommodates the ink roll case 401 of the carriage, it is fitted into the space 407*d* while the cams 401*a* and 401*b* are faced to the guide frames 407*a*. In an initial stage of fitting, the cams 401*a* and 401*b* contact to the portions of the guide frames 407*a* other than the cam 407*b*. Accordingly, as shown in FIG. 32, the ink roll case 401 together with the ink rolls 403 and 404 of different colors are moved away from the type drum 408 and the spring 412 is flexed outwardly. As the fitting of the ink roll case 401 further advances under this condition, the complementary cams 401*a* and 401*b* are fitted to the cams 407*b* and the spring 412 presses the cams 407*b* so that the ink roll case 401 together with the ink rolls 403 and 404 of different colors are pressed to the type belts 409 and 411 of the type drum 408 as shown in FIG. 33. Under this condition, as seen from FIG. 33, the spring 412 is fitted into the recess 401*c* formed on the outer surface of the ink roll case 401. When the spring 412 is fitted into the recess 401*c*, the spring 412 is bound by the recess 401*c* so that the ink roll case 401 is prevented from coming out of the carriage 407, and the ink rolls 403 and 404 of different colors are kept pressed to the type belts 409–411.

When the ink roll case 401 is to be removed, the opposite operation to the above is carried out. Thus, the cams 401*a* and 401*b* are disengaged from the complementary cams 407*b* and the contact of the ink rolls 403 and 404 and the type belts 409–411 is released immediately before the removal Accordingly, the contact of the ink rolls 403 and 404 of different colors to the type belts of different colors is prevented.

As seen from the above, according to the present embodiment, the cams are formed on the ink roll case which contains the ink rolls of different colors and the cams complementary to the cams of the ink roll case are formed on the carriage on which the ink roll case is mounted. Accordingly, when the ink roll case is mounted or removed, the ink rolls of different colors are separated from the type belts of the type drum. As a result, the mixing of inks of different colors due to the application of inks of different colors to the type belts of different colors is completely prevented.

We claim:

1. A printer comprising:

a cylindrical drum having a drive gear integral therewith;

a plurality of resilient type belts mounted on said cylindrical drum, each having a plurality of types thereon;

a print hammer positioned in said cylindrical drum;

means for selecting one of said type belts and for moving said selected type belt to a position opposite said print hammer;

inking means for applying ink to said types of the selected type belt;

means for causing said print hammer to project a type of said selected type belt;

rotating means for rotating said cylindrical drum, wherein said cylindrical drum is rotated as said type of said selected type belt is projected;

a worm shaft which meshes with said drive gear; and a rack plate which is selectively meshed with said drive gear, wherein said cylindrical drum is moved in the direction of a print line by the engagement of said drive gear and said rack plate.

2. A printer comprising:

a first ink roller;

a second ink roller of different color from that of said first ink roller;

a first typefont belt in association with said first ink roller;

a second typefont belt in association with said second ink roller;

hammer means provided within said first and second typefont belts to protrude typefonts on said first and second typefont belts; and a plane shaped platen having a first portion and a second portion, said first portion for receiving protruded type of said first typefont belt and said second portion for receiving protruded type of said second typefont belt.

3. A compact serial printer, comprising:

a cylindrical type drum having a plurality of resilient type belts, each belt having a plurality of types;

a carriage for carrying said type drum;

inking means for applying ink to said type belts;

means for moving said carriage;

rotating means for rotating said type drum in a print line direction;

control means for controlling the rotation of said type drum; and a print hammer for projecting said types toward a printing paper, one end of said print hammer being positioned in said type drum and the other end of said print hammer being positioned out of said type drum, wherein said print hammer projects one of said types as said carriage is moved and said type drum is rotated, whereby printing is performed when said type drum is rotating and the type is in contact with the printing paper;

wherein said carriage has a drum gear which is integral with said type drum, wherein said drum gear meshes with a worm gear, and wherein said drum gear engages said control means whereby said drum gear is moved in the print line direction by said worm gear.

4. A compact serial printer according to claim 3, further comprising means for reverse feeding of the printing paper, and wherein said type belts include numeral type belts and symbol type belts which are arranged with a predetermined pitch, said feeding means being capable of reversibly feeding the printing paper with said predetermined pitch.

5. A compact serial printer according to claim 3, further comprising means for reversibly feeding the printing paper.

* * * * *

UNITED STATES PATENT AND TRADEMARK OFFICE

CERTIFICATE OF CORRECTION

PATENT NO. : 4,504,159

DATED : March 12, 1985

INVENTOR(S) : HIROFUMI HIRANO, ET AL.

It is certified that error appears in the above-identified patent and that said Letters Patent is hereby corrected as shown below:

In the Abstract: line 3, change "prevent" to --prevents--.

Column 1: line 41, change "other" to --still another--;

line 55, change "other" to --another--;

line 68, change "views" to --view--.

Column 2: line 1, change "view" to --views--;

line 19, change "shows" to --show--;

line 20, insert a period after "construction";

line 46, change "uging" to --urging--.

Column 3: line 39, change "to roll" to --rolling--.

Column 4: line 1, change "other" to --another--;

line 65, change "28a" to --728a--;

Column 5: line 30, delete "the";

line 34, change "is" to --are--.

UNITED STATES PATENT AND TRADEMARK OFFICE

CERTIFICATE OF CORRECTION

PATENT NO. : 4,504,159

DATED : March 12, 1985

INVENTOR(S) : HIROFUMI HIRANO, ET AL.

It is certified that error appears in the above-identified patent and that said Letters Patent is hereby corrected as shown below:

Column 6: line 44, delete "to" (second occurrence);

line 49, change "908" to --909--;

line 50, insert a comma after "motor";

line 57, change "an" to --a--.

Column 8: line 18, insert a comma after "returned";

line 39, delete "to".

Column 11: line 14, change "clutchs" to --clutches--;

line 60, change "move" to --moves--.

Column 12: line 6, change "a" to --an-- (second occurrence);

line 55, change "186" (second occurrence) to --189--.

Column 13: line 19, change "color" to --collar--.

Column 14: line 14, change "angle" to --angles--.

UNITED STATES PATENT AND TRADEMARK OFFICE

CERTIFICATE OF CORRECTION

PATENT NO. : 4,504,159

DATED : March 12, 1985

INVENTOR(S) : HIROFUMI HIRANO, ET AL.

It is certified that error appears in the above-identified patent and that said Letters Patent is hereby corrected as shown below:

Column 16: line 13, change "excentric" to --eccentric--;

line 29, delete "cam".

Column 17: line 14, insert "for" between "except" and "the".

Column 19: line 37, put a space between "301a" and "of";

line 41, change "plate" to --pulley--.

Column 20: line 28, insert "on" after "320c".

Column 21: line 36, change "are" to --is--.

Column 22: lines 6&7, change "shift" to --shaft--;

line 24, insert --is-- after "and".

Column 23: line 23, change "371" to --371b--.

Column 24: line 23, insert --the-- after "exactly".

UNITED STATES PATENT AND TRADEMARK OFFICE

CERTIFICATE OF CORRECTION

PATENT NO. : 4,504,159

DATED : March 12, 1985

INVENTOR(S) : HIROFUMI HIRANO, ET AL.

It is certified that error appears in the above-identified patent and that said Letters Patent is hereby corrected as shown below:

Column 26: line 19, change "lever" to --levers--;

line 34, change "color" to --colors--;

line 39, delete the comma.

Column 27: line 49, change "are" to --is--;

line 55, change "are" to --is--.

Column 28: line 2, insert a period between "removal" and "Accordingly".

Signed and Sealed this

*Twenty-first* Day of *January 1986*

[SEAL]

*Attest:*

DONALD J. QUIGG

*Attesting Officer* *Commissioner of Patents and Trademarks*